US011264157B2

(12) United States Patent
Choi

(10) Patent No.: US 11,264,157 B2
(45) Date of Patent: Mar. 1, 2022

(54) MAGNETIC FORCE CONTROL DEVICE AND MAGNETIC BODY HOLDING DEVICE USING SAME

(71) Applicant: Tae Kwang Choi, Gwangmyeong-Si (KR)

(72) Inventor: Tae Kwang Choi, Gwangmyeong-Si (KR)

(73) Assignee: Tae Kwang Choi, Gwangmyeong-Si (KR)

( * ) Notice: Subject to any disclaimer, the term of this patent is extended or adjusted under 35 U.S.C. 154(b) by 177 days.

(21) Appl. No.: 16/622,854

(22) PCT Filed: Aug. 3, 2018

(86) PCT No.: PCT/KR2018/008833
§ 371 (c)(1),
(2) Date: Dec. 13, 2019

(87) PCT Pub. No.: WO2019/054629
PCT Pub. Date: Mar. 21, 2019

(65) Prior Publication Data

US 2020/0203048 A1 Jun. 25, 2020

(30) Foreign Application Priority Data

Sep. 15, 2017 (KR) ..... 10-2017-0118457
Mar. 29, 2018 (KR) ..... 10-2018-0036840
(Continued)

(51) Int. Cl.
*H01F 7/04* (2006.01)
*H01F 7/126* (2006.01)
(Continued)

(52) U.S. Cl.
CPC ..... *H01F 7/04* (2013.01); *H01F 7/122* (2013.01); *H01F 7/126* (2013.01); *H01F 7/14* (2013.01)

(58) Field of Classification Search
CPC .... H01F 7/122; H01F 7/126; H01F 2007/208; H01F 7/04; H01F 7/02; H01F 7/0247; H01F 7/14; H01F 7/20; H01F 7/206
See application file for complete search history.

(56) References Cited

U.S. PATENT DOCUMENTS 4,075,589 A * 2/1978 Braillon ..... B23Q 3/1546 335/286
7,453,341 B1 * 11/2008 Hildenbrand ..... H02K 26/00 310/154.01
(Continued)

FOREIGN PATENT DOCUMENTS

CN 2161590 4/1994
CN 2384300 6/2000
(Continued)

OTHER PUBLICATIONS

Office Action issued by CNIPA to the counterpart CN application 201880031060.6.
(Continued)

*Primary Examiner* — Bernard Rojas
(74) *Attorney, Agent, or Firm* — AEON Law, PLLC; Adam L. K. Philipp; David V. H. Cohen

(57) ABSTRACT

A magnetic force control device includes a first pole piece having an interaction surface, made of a ferromagnetic material, and configured to be in contact with an N pole of a permanent magnet, a second pole piece having an interaction surface, made of a ferromagnetic material, and configured to be in contact with an S pole of the permanent magnet or another permanent magnet different from the permanent magnet, rotary permanent magnet configured to
(Continued)

be rotatable to define a first arrangement state in which an N pole thereof is magnetically connected to the second pole piece and an S pole thereof is magnetically connected to the first pole piece and a second arrangement state in which the N pole is magnetically connected to the first pole piece and the S pole is magnetically connected to the second pole piece.

20 Claims, 27 Drawing Sheets

(30) Foreign Application Priority Data

Jun. 21, 2018 (KR) ..... 10-2018-0071675
Jul. 31, 2018 (KR) ..... 10-2018-0089368

(51) Int. Cl.
*H01F 7/122* (2006.01)
*H01F 7/14* (2006.01)

(56) References Cited

U.S. PATENT DOCUMENTS 9,969,061 B2 * 5/2018 Choi ..... B23Q 3/1543
2013/0135067 A1 * 5/2013 Choi ..... H01F 7/206 335/290
2016/0005519 A1 * 1/2016 Choi ..... H01F 7/0257 335/290
2018/0315563 A1 * 11/2018 Morton ..... H01H 36/002
2020/0185137 A1 * 6/2020 Morton ..... H01F 7/206
2020/0227191 A1 * 7/2020 Choi ..... H02K 16/00

FOREIGN PATENT DOCUMENTS

| | | | |
|---|---|---|---|
| CN | 2915811 | | 6/2007 |
| CN | 101426664 | A | 5/2009 |
| CN | 103221179 | A | 7/2013 |
| CN | 106104717 | A | 11/2016 |
| JP | 2002110418 | A | 4/2002 |
| JP | 2004193532 | A | 7/2004 |
| JP | 2007208024 | A | 8/2007 |
| JP | 4273249 | B1 | 6/2009 |
| JP | 2013537712 | A | 10/2013 |
| JP | 2016219465 | A | 12/2016 |
| KR | 101130218 | B1 | 3/2012 |
| KR | 101131134 | B1 | 4/2012 |
| KR | 20120119412 | A | 10/2012 |
| KR | 101427066 | B1 | 8/2014 |
| KR | 10-2018-0089368 | A | 7/2018 |
| WO | 2011049282 | A1 | 4/2011 |

OTHER PUBLICATIONS

Notice of Reasons for Refusal issued for Japanese Patent Application No. 2019-568185 dated Feb. 15, 2021.

* cited by examiner (a)

(b)

(a)

100'''

(b)

100'''

MAGNETIC FORCE CONTROL DEVICE AND MAGNETIC BODY HOLDING DEVICE USING SAME

TECHNICAL FIELD

The present invention relates to a magnetic force control device and a magnetic body holding device using the same, and more particularly, to a magnetic force control device configured to control a magnetic force on an interaction surface by controlling an arrangement state of a freely rotating permanent magnet by means of a coil, and a magnetic body holding device using the same.

BACKGROUND ART

A magnetic body holding device, such as a permanent magnet workpiece holding device, is a device used to attach, by using a magnetic force, an attachment object made of a magnetic material such as iron. Recently, the magnetic body holding device is widely used as an internal device attached to a mold clamp for an injection machine, a mold clamp for a press device, a chuck for a machine tool, or the like. The present invention relates to a magnetic force control device and a magnetic body holding device using the same, and more particularly, to a magnetic force control device configured to control a magnetic force on an interaction surface by controlling an arrangement state of a freely rotating permanent magnet by means of a coil, and a magnetic body holding device using the same.

Basically, the magnetic body holding device is configured to attach the attachment object, which is a magnetic body, to an interaction surface by using a high magnetic force of a permanent magnet. In order to release the attachment object, a magnetic flow from the permanent magnet is controlled such that the magnetic flow is prevented from being formed on the interaction surface, thereby separating the attachment object from the interaction surface.

The present applicant has proposed a permanent magnet workpiece holding device configured to hold and release an object by changing a magnetic circuit by rotating a permanent magnet (see Patent Document 1). However, in the case of the permanent magnet workpiece holding device, because a motor rotates the permanent magnet, a large amount of force needs to be applied to the motor. As a result, usability of the permanent magnet workpiece holding device is not good, and the permanent magnet workpiece holding device does not come into practical use because a large amount of power is applied to the motor.

(Patent Document 1)

Korean Patent No. 10-1131134 (Title of Invention: Permanent Magnet Workpiece Holding Device)

DISCLOSURE

Technical Problem

An object to be achieved by the present invention is to provide a magnetic force control device configured to control a magnetic force on an interaction surface by controlling an arrangement state of a freely rotating permanent magnet by means of a coil, and a magnetic body holding device using the same.

Technical problems of the present invention are not limited to the aforementioned technical problems, and other technical problems, which are not mentioned above, may be clearly understood by those skilled in the art from the following descriptions.

Technical Solution

A magnetic force control device according to an exemplary embodiment of the present invention includes: a first pole piece having an interaction surface, made of a ferromagnetic material, and configured to be in contact with an N pole of a permanent magnet; a second pole piece having an interaction surface, made of a ferromagnetic material, and configured to be in contact with an S pole of the permanent magnet or another permanent magnet different from the permanent magnet; a rotary permanent magnet configured to be rotatable to define a first arrangement state in which an N pole thereof is magnetically connected to the second pole piece and an S pole thereof is magnetically connected to the first pole piece and a second arrangement state in which the N pole is magnetically connected to the first pole piece and the S pole is magnetically connected to the second pole piece; and a coil wound around at least one of the first pole piece and the second pole piece, in which switching between the first arrangement state and the second arrangement state is performed by rotating the rotary permanent magnet by controlling a current applied to the coil, such that magnetic force on the interaction surfaces of the first and second pole pieces is controlled.

According to another aspect of the present invention, the first pole piece is in contact with the N pole of the permanent magnet, the second pole piece is in contact with the S pole of the permanent magnet, and the permanent magnet is positioned to be closer to the interaction surface than the rotary permanent magnet.

According to yet another aspect of the present invention, the coil is disposed between the permanent magnet and the rotary permanent magnet.

According to yet another aspect of the present invention, the magnetic force control device includes the permanent magnet and a plurality of another permanent magnets, in which the plurality of permanent magnets is magnetically connected to one another by a pole piece made of a ferromagnetic material.

According to yet another aspect of the present invention, the magnetic force control device further includes a connecting pole piece disposed to be magnetically connected to the first pole piece and the second pole piece and made of a ferromagnetic material, in which the coil is wound around at least one of the first pole piece, the second pole piece, and the connecting pole piece.

According to yet another aspect of the present invention, the second pole piece is in contact with the S pole of the permanent magnet and the S pole of another permanent magnet, the permanent magnet is a first permanent magnet, another permanent magnet different from the permanent magnet is a second permanent magnet, the connecting pole piece is in contact with the S pole of the first permanent magnet and in contact with an N pole of the second permanent magnet, and the connecting pole piece is spaced apart from and magnetically connected to the first pole piece and the second pole piece while having a gap.

According to yet another aspect of the present invention, the first permanent magnet, the second permanent magnet, and the rotary permanent magnet are disposed in a row.

According to yet another aspect of the present invention, the coil is disposed on the first pole piece between the rotary permanent magnet and the first permanent magnet or the second pole piece between the rotary permanent magnet and the second permanent magnet.

According to yet another aspect of the present invention, the coil is disposed between the interaction surface of the first pole piece and the first permanent magnet, and the coil is disposed between the interaction surface of the second pole piece and the second permanent magnet.

According to yet another aspect of the present invention, the coil is further disposed between the gap and the first permanent magnet, and the coil is further disposed between the gap and the second permanent magnet.

According to yet another aspect of the present invention, the second pole piece is in contact with the S pole of the permanent magnet and the S pole of another permanent magnet, the permanent magnet is a first permanent magnet, another permanent magnet different from the permanent magnet is a second permanent magnet, in which the magnetic force control device further including: a third pole piece configured to be in contact with the S pole of the first permanent magnet and made of a ferromagnetic material; and a fourth pole piece configured to be in contact with an N pole of the second permanent magnet and made of a ferromagnetic material, in which the connecting pole piece is configured to be movable between a first position at which the connecting pole piece is magnetically connected to the third pole piece and the fourth pole piece and a second position at which the connecting pole piece is not magnetically connected to at least one of the third pole piece and the fourth pole piece, and in which the connecting pole piece is spaced apart from and magnetically connected to the first pole piece and the second pole piece while having a gap even though the connecting pole piece is positioned at the first position.

According to yet another aspect of the present invention, each of the third pole piece and the fourth pole piece has an interaction surface.

According to yet another aspect of the present invention, an impact mitigating member having elasticity is interposed between the connecting pole piece and the third pole piece or between the connecting pole piece and the fourth pole piece.

According to yet another aspect of the present invention, an elastic member, which applies force in a direction in which the connecting pole piece becomes distant from the third pole piece or the fourth pole piece, is interposed between the connecting pole piece and the third pole piece or between the connecting pole piece and the fourth pole piece.

According to yet another aspect of the present invention, the second pole piece is in contact with the S pole of the permanent magnet, and the connecting pole piece is spaced apart from and magnetically connected to the first pole piece and the second pole piece while having a gap.

According to yet another aspect of the present invention, the rotary permanent magnet is positioned to be closer to the interaction surfaces than the permanent magnet.

According to yet another aspect of the present invention, the coils are wound around the first pole piece and the second pole piece between the rotary permanent magnet and the permanent magnet, respectively, the coil is wound around the first pole piece between the interaction surface of the first pole piece and the rotary permanent magnet, and the coil is wound around the second pole piece between the interaction surface of the second pole piece and the rotary permanent magnet.

According to yet another aspect of the present invention, the rotary permanent magnet is a first rotary permanent magnet, the permanent magnet is a first permanent magnet, in which the magnetic force control device further including: a third pole piece having an interaction surface and made of a ferromagnetic material; a second permanent magnet disposed such that an N pole thereof is in contact with the first pole piece and an S pole thereof is in contact with the third pole piece; and a second rotary permanent magnet configured to be rotatable to define a first arrangement state in which an N pole thereof is magnetically connected to the third pole piece and an S pole thereof is magnetically connected to the first pole piece and a second arrangement state in which the N pole is magnetically connected to the first pole piece and the S pole is magnetically connected to the third pole piece, and in which the connecting pole piece is spaced apart from and magnetically connected to the third pole piece while having a gap.

According to yet another aspect of the present invention, the second pole piece is in contact with the S pole of the permanent magnet, and the connecting pole piece is configured to be movable between a first position at which the connecting pole piece is not magnetically connected to at least one of the first pole piece and the second pole piece and a second position at which the connecting pole piece is magnetically connected to the first pole piece and the second pole piece.

According to yet another aspect of the present invention, the coils are wound around the first pole piece and the second pole piece between the rotary permanent magnet and the permanent magnet, respectively.

According to yet another aspect of the present invention, the rotary permanent magnet is a first rotary permanent magnet, the permanent magnet is a first permanent magnet, in which the magnetic force control device further including: a third pole piece having an interaction surface and made of a ferromagnetic material; a second permanent magnet disposed such that an N pole thereof is in contact with the first pole piece and an S pole thereof is in contact with the third pole piece; and a second rotary permanent magnet configured to be rotatable to define a first arrangement state in which an N pole thereof is magnetically connected to the third pole piece and an S pole thereof is magnetically connected to the first pole piece and a second arrangement state in which the N pole is magnetically connected to the first pole piece and the S pole is magnetically connected to the third pole piece, and in which the connecting pole piece is configured such that adjacent pole pieces, among the first pole piece, the second pole piece, and the third pole piece, are not magnetically connected to one another in the first position, and the connecting pole piece is configured such that the connecting pole piece is magnetically connected to all the first pole piece, the second pole piece, and the third pole piece in the second position.

According to yet another aspect of the present invention, the first pole piece is in contact with the N pole of the permanent magnet, the second pole piece is in contact with the S pole of the permanent magnet, the coil is disposed between the permanent magnet and the rotary permanent magnet, the pair of interaction surfaces is formed on the first pole piece, the pair of interaction surfaces is formed on the second pole piece, respectively. A direction of the interaction surfaces is parallel to a direction along a rotation axis of the rotary permanent magnet.

A magnetic force control device according to another exemplary embodiment of the present invention includes: a center pole piece having an interaction surface and made of a ferromagnetic material; a peripheral pole piece disposed to surround at least a part of the center pole piece, having an interaction surface, and made of a ferromagnetic material; a permanent magnet disposed such that any one of an N pole and an S pole is in contact with the center pole piece and the other of the N pole and the S pole is in contact with the peripheral pole piece; a rotary permanent magnet configured to be rotatable to define a first arrangement state in which an S pole thereof is spaced apart from and magnetically connected to the center pole piece and an N pole thereof is spaced apart from and magnetically connected to the peripheral pole piece and a second arrangement state in which the S pole is spaced apart from and magnetically connected to the peripheral pole piece and the N pole is spaced apart from and magnetically connected to the center pole piece; and a coil wound around at least one of the center pole piece and the peripheral pole piece, in which switching between the first arrangement state and the second arrangement state is performed by rotating the rotary permanent magnet by controlling a current applied to the coil, such that magnetic force on the interaction surfaces of the center pole piece and the peripheral pole piece is controlled.

According to another aspect of the present invention, at least two permanent magnets are symmetrically disposed based on the center pole piece, and the rotary permanent magnet is disposed such that the N pole or the S pole is directed toward the interaction surface of the center pole piece in the first arrangement state or the second arrangement state.

According to yet another aspect of the present invention, the N pole of the permanent magnet is in contact with the center pole piece, and the coil is wound around the center pole piece between the permanent magnet and the rotary permanent magnet.

According to yet another aspect of the present invention, the rotary permanent magnet is configured to be mechanically fixed to maintain the first arrangement state or the second arrangement state and the fixing of the rotary permanent magnet is released when changing the arrangement states.

According to yet another aspect of the present invention, the rotary permanent magnet has a circular portion having outer edges spaced apart from a rotation center at an equal distance, and a non-circular portion having outer edges of which the distance from the rotation center is smaller than the distance between the rotation center and the circular portion, and the N pole and the S pole of the rotary permanent magnet are divided by the non-circular portion.

According to yet another aspect of the present invention, the first pole piece and the second pole piece face the entire circular portion when the rotary permanent magnet in the first arrangement state or the second arrangement state.

A magnetic body holding device according to an exemplary embodiment of the present invention includes the configuration of the magnetic force control device.

Advantageous Effects

The magnetic force control device according to the present invention is easily controlled because even though a small amount of current is applied, the rotary permanent magnet is rotated, and the magnetic flow is changed, such that holding and releasing operations are performed.

In addition, the magnetic force control device according to the present invention requires a small amount of current only when holding or releasing an object, thereby achieving low power consumption.

MODES OF THE INVENTION

Figure 1A:
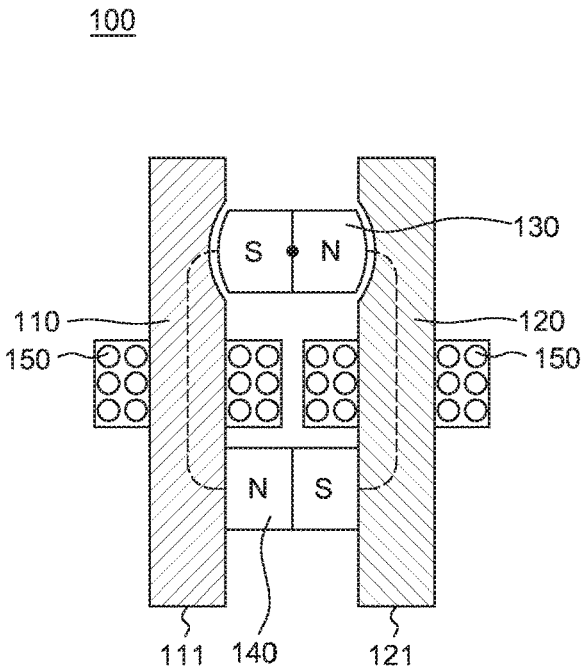
FIGS. 1A to 1D are schematic cross-sectional views illustrating a magnetic force control device according to one exemplary embodiment of the present invention.

Advantages and features of the present invention and methods of achieving the advantages and features will be clear with reference to exemplary embodiments described in detail below together with the accompanying drawings. However, the present invention is not limited to the exemplary embodiments disclosed herein but will be implemented in various forms. The exemplary embodiments of the present invention are provided so that the present invention is completely disclosed, and a person with ordinary skill in the art can fully understand the scope of the present invention. The present invention will be defined only by the scope of the appended claims.

When an element or layer is referred to as being "on" another element or layer, it can be directly on the other element or layer or intervening elements or layers may also be present.

Terms "first", "second", and the like may be used to describe various constituent elements, but the constituent elements are of course not limited by these terms. These terms are merely used to distinguish one constituent element from another constituent element. Therefore, the first constituent element mentioned hereinafter may of course be the second constituent element within the technical spirit of the present invention.

Throughout the specification, the same reference numerals denote the same constituent elements.

The size and thickness of each component illustrated in the drawings are shown for ease of description, but the present invention is not necessarily limited to the size and thickness of the illustrated component.

Respective features of several exemplary embodiments of the present invention may be partially or entirely coupled to or combined with each other, and as sufficiently appreciated by those skilled in the art, various technical cooperation and operations may be carried out, and the respective exemplary embodiments may be implemented independently of each other or implemented together correlatively.

Hereinafter, exemplary embodiments of a magnetic force control device according to the present invention will be described with reference to the accompanying drawings.

A magnetic force control device according to the present invention is a device controlled to generate or not to generate magnetic force to an outside magnetic body by changing magnetic characteristics of an interaction surface. The magnetic force control device according to the present invention may be comprehensively used for a magnetic body holding device, a power device, and the like. Hereinafter, an example in which the magnetic force control device is used for a magnetic body holding device will be described. However, the application of the magnetic force control device is not limited thereto.

FIGS. 1A to 1D are schematic cross-sectional views illustrating a magnetic force control device according to one exemplary embodiment of the present invention.

A magnetic force control device 100 according to the present exemplary embodiment includes a first pole piece 110, a second pole piece 120, a rotary permanent magnet 130, a permanent magnet 140, and coils 150.

The first pole piece 110 is made of a ferromagnetic material such as iron and has an interaction surface 111. In addition, the second pole piece 120 is made of a ferromagnetic material such as iron and has an interaction surface 121.

The rotary permanent magnet 130 is rotatably disposed to switch between a first arrangement state (arrangement state in FIGS. 1A and 1B) in which an S pole is adjacent to the first pole piece 110 and magnetically connected to the first pole piece 110 and an N pole is adjacent to the second pole piece 120 and magnetically connected to the second pole piece 120 and a second arrangement state (arrangement state in FIGS. 1C and 1D) in which the N pole is adjacent to the first pole piece 110 and magnetically connected to the first pole piece 110 and the S pole is adjacent to the second pole piece 120 and magnetically connected to the second pole piece 120.

Specifically, the rotary permanent magnet 130 may be disposed between the first pole piece 110 and the second pole piece 120, thereby magnetically connecting the first pole piece 110 and the second pole piece 120. However, magnetic flows are formed in the opposite directions respectively when the rotary permanent magnet 130 is in a first arrangement state and a second arrangement state.

The rotary permanent magnet 130 may be configured to be rotatable with minimized friction. In addition, in the first arrangement state and the second arrangement state, the shorter the spacing distance between the first pole piece 110 and the second pole piece 120, the better because a larger magnetic flow may be formed.

The configuration in which the rotary permanent magnet 130 is "magnetically connected" to the pole pieces 110 and 120 includes a case in which the rotary permanent magnet 130 is spaced apart from the pole pieces 110 and 120 so that the magnetic flow is formed in the pole pieces 110 and 120 by magnetic force of the rotary permanent magnet 130 even though the rotary permanent magnet 130 is not direct contact with the pole pieces 110 and 120. For example, a case in which the magnetic flow having intensity of A % or more of intensity of the magnetic flow generated when the rotary permanent magnet 130 is in contact with the pole pieces 110 and 120 is formed in the pole pieces 110 and 120 may be determined as the case in which the rotary permanent magnet 130 is magnetically connected to the pole pieces 110 and 120. Here, A may be 80, 70, 60, 50, 40, 30, 20, or the like. However, as described above, the spacing distance between the rotary permanent magnet 130 and the pole pieces 110 and 120 may be set to a minimum distance.

Meanwhile, in the present exemplary embodiment, an example in which the rotary permanent magnet 130 is formed in a particular shape is described. However, the shape of the rotary permanent magnet 130 is not limited thereto, and a combination of a permanent magnet and a pole piece may be provided. Various configurations of the rotary permanent magnet 130 will be described below with reference to FIG. 9.

The permanent magnet 140 is disposed such that the N pole is in contact with the first pole piece 110 and the S pole is in contact with the second pole piece 120. The permanent magnet 140 may be positioned to be closer to the interaction surfaces 111 and 121 than the rotary permanent magnet 130.

The coil 150 may be wound around at least one of the first pole piece 110 and the second pole piece 120. The coil 150 may be positioned at a position appropriate to change the magnetic flow. In the present exemplary embodiment, the example in which the coil 150 is disposed between the rotary permanent magnet 130 and the permanent magnet 140 is described, and this disposition is advantageous in efficiently controlling the magnetic flow.

A principle for holding and releasing an object 1, which is a magnetic body, will be described below with reference back to FIGS. 1A to 1D.

First, referring to FIG. 1A, when no current is applied to the coil 150, the rotary permanent magnet 130 is automatically disposed in the first arrangement state as the first and second pole pieces 110 and 120 are magnetized by the permanent magnet 140. Therefore, an internal circulation magnetic flow is formed as indicated by the dotted line. Therefore, no magnetic flow is formed in a direction toward the interaction surfaces 111 and 121, such that the object cannot be held by the interaction surfaces 111 and 121.

Figure 1B:
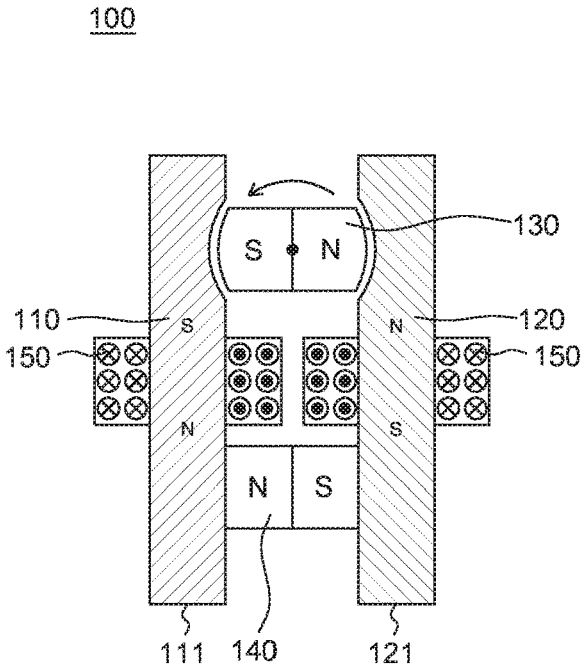

As illustrated in FIG. 1B, the current is applied to the coils 150 to form the magnetic flow in the direction toward the interaction surfaces 111 and 121. That is, the coil 150 wound around the first pole piece 110 is controlled so that the N pole is formed in the direction toward the interaction surface 111 of the first pole piece 110 and the S pole is formed in the opposite direction. The coil 150 wound around the second pole piece 120 is controlled so that the S pole is formed in the direction toward the interaction surface 121 of the second pole piece 120 and the N pole is formed in the opposite direction.

When the current applied to the coil 150 is sufficiently high, a surface of the first pole piece 110 facing the rotary permanent magnet 130 has the S pole, and a surface of the second pole piece 120 facing the rotary permanent magnet 130 has the N pole. Therefore, the rotary permanent magnet 130 receives repulsive force from the respective poles, receives rotational force, and thus rotates.

Figure 1C:
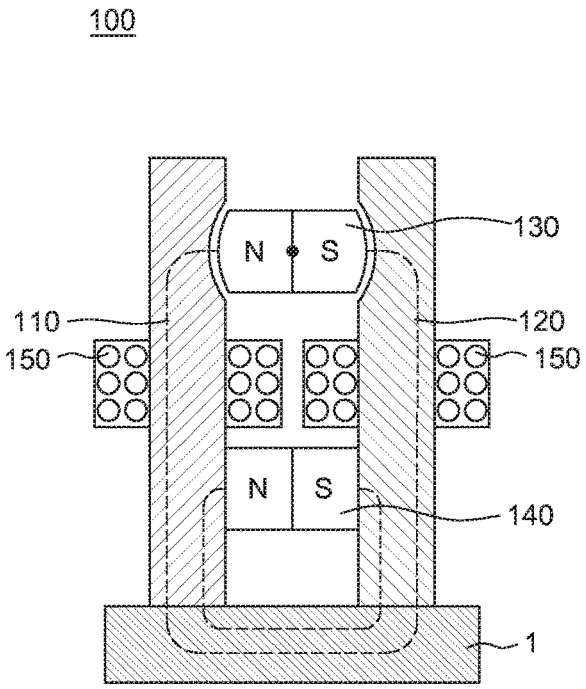

As illustrated in FIG. 1C, the rotary permanent magnet 130 switches to the second arrangement state, and the interaction surfaces 111 and 121 have the N pole and the S pole, respectively, thereby holding the object 1. In this case, the magnetic flow is formed to pass through the object 1, as indicated by the dotted line in FIG. 1C. Once the magnetic flow is formed as illustrated in FIG. 1C, the magnetic flow is maintained and the state of holding the object is maintained even though the current applied to the coil 150 is cut off.

Figure 1D:
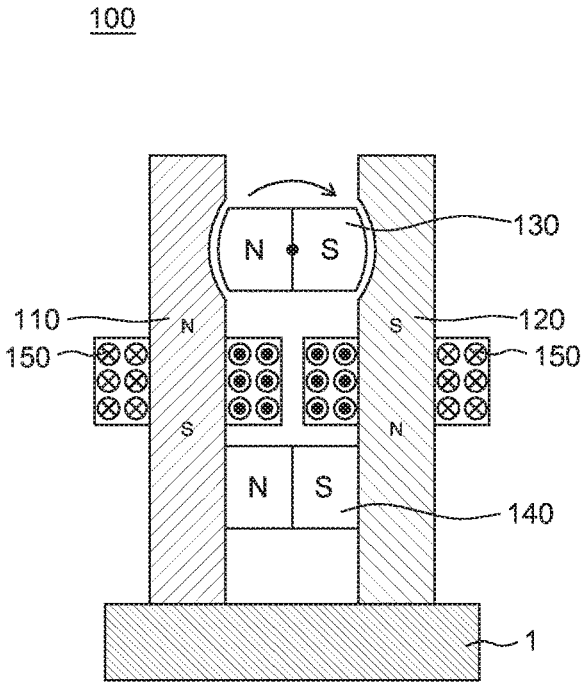

As illustrated in FIG. 1D, the current is applied to the coil 150 to release the held object 1. That is, when the current is applied to the coil 150 in the direction opposite to the direction illustrated in FIG. 1B, the surface of the first pole piece 110 facing the rotary permanent magnet 130 has the N pole, and the surface of the second pole piece 120 facing the rotary permanent magnet 130 has the S pole. In this case, the rotary permanent magnet 130 receives repulsive force from the respective poles and receives rotational force, such that the arrangement state is switched to the first arrangement state, as illustrated in FIG. 1A. Therefore, the object 1 may be released from the interaction surfaces 111 and 121.

Once the rotary permanent magnet 130 switches to the first arrangement state, the internal circulation magnetic flow is formed as indicated by the dotted line in FIG. 1A even though no current is applied to the coil 150, and as a result, the object 1 cannot be held by the interaction surfaces 111 and 121.

Meanwhile, because the rotation direction of the rotary permanent magnet 130 illustrated in FIGS. 1B and 1D is illustrative, and the rotary permanent magnet 130 may rotate in any direction. Even in the following description, the rotation direction of the rotary permanent magnet 130 is just illustrative.

That is, the magnetic force control device 100 according to the present exemplary embodiment switches between the first arrangement state and the second arrangement state by rotating the rotary permanent magnet 130 by controlling the current applied to the coil 150, thereby controlling the magnetic force on the interaction surfaces 111 and 121 of the first and second pole pieces 110 and 120.

Figure 2:
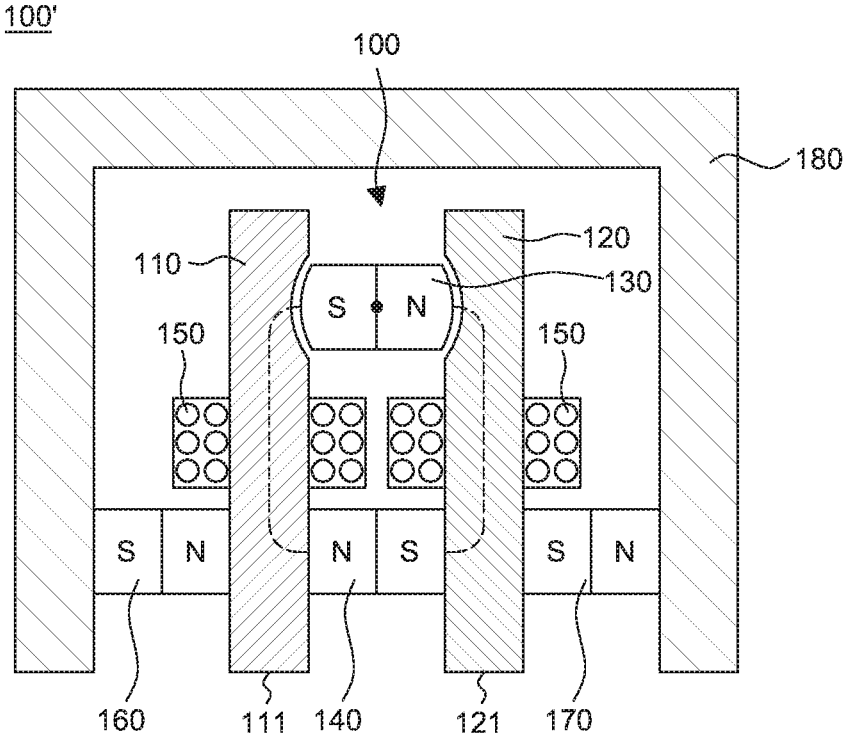
FIG. 2 a schematic cross-sectional view of a magnetic force control device according to another exemplary embodiment.

FIG. 2 a schematic cross-sectional view of a magnetic force control device according to another exemplary embodiment.

A magnetic force control device 100' in FIG. 2 is characterized by adding a first permanent magnet 160, a second permanent magnet 170, and a pole piece 180 to the magnetic force control device 100 in FIGS. 1A to 1D.

The first permanent magnet 160 is disposed such that the N pole is in contact with the first pole piece 110 and the S pole is in contact with the pole piece 180. The second permanent magnet 170 is disposed such that the S pole is in contact with the second pole piece 120 and the N pole is in contact with the pole piece 180.

The pole piece 180 magnetically connects the first permanent magnet 160 and the second permanent magnet 170, thereby generating the magnetic flow therein as indicated by the dotted line. The pole piece 180 may be used as a casing, together with a magnetic shield.

The magnetic force control device 100' according to the present exemplary embodiment has a larger number of permanent magnets 140, 160, and 170 than the magnetic force control device 100, thereby obtaining higher holding force.

FIGS. 3A to 3E are schematic cross-sectional views illustrating a magnetic force control device according to yet another exemplary embodiment of the present invention. In addition, FIG. 3F is a cross-sectional view illustrating a magnetic force control device made by modifying the magnetic force control device illustrated in FIGS. 3A to 3E.

Referring to FIGS. 3A to 3E, the magnetic force control device 200 according to the present exemplary embodiment includes the first pole piece 110, the second pole piece 120, the rotary permanent magnet 130, the coils 150, the first permanent magnet 160, the second permanent magnet 170, and a connecting pole piece 280.

In the present description, a specific description of the components identical to the components of the magnetic force control device 100 in FIGS. 1A to 1D will be omitted, and a difference will be specifically described.

The first permanent magnet 160 is disposed such that the N pole is in contact with the first pole piece 110 and the S pole is in contact with the connecting pole piece 280. The second permanent magnet 170 is disposed such that the S pole is in contact with the second pole piece 120 and the N pole is in contact with the connecting pole piece 280.

Here, in the present exemplary embodiment, the configuration in which the rotary permanent magnet 130, the first permanent magnet 160, and the second permanent magnet 170 may be disposed in a row may be advantageous in implementing the magnetic flow. Specifically, when the rotary permanent magnet 130 is in the first arrangement state and the second arrangement state, the configuration in which the poles are disposed in a row may be advantageous in implementing the magnetic flow.

The connecting pole piece 280 is made of a ferromagnetic material such as iron, the S pole of the first permanent magnet 160 is in contact with the connecting pole piece 280, and the N pole of the second permanent magnet 170 is in contact with the connecting pole piece 280. In addition, the connecting pole piece 180 is disposed to be magnetically connected to the first pole piece 110 and the second pole piece 120 while having a gap G with the first pole piece 110 and the second pole piece 120.

Here, the gap G is set such that the connecting pole piece 280 may be magnetically connected to the pole pieces 110 and 120. That is, when the magnetic flow having intensity of B % or more of intensity of the magnetic flow generated when the connecting pole piece 280 is in contact with the pole pieces 110 and 120 is transferred, it may be determined that the connecting pole piece 280 is magnetically connected to the pole pieces 110 and 120. Here, B may be 60, 50, 40, 30, 20, or the like.

The coil 150 may be wound around at least one of the first pole piece 110, the second pole piece 120, and the connecting pole piece 280. The coil 150 needs to be disposed at a position appropriate to change the magnetic flow. In the present exemplary embodiment, an example in which the coils 150 are disposed on the first and second pole pieces 110 and 120 so as to be adjacent to the interaction surfaces 111 and 121, respectively, is described. The configuration in which the coils 150 are disposed between the interaction surface 111 of the first pole piece 110 and the first permanent magnet 160 and between the interaction surface 121 of the second pole piece 120 and the second permanent magnet 170 is advantageous in making it possible to directly control the magnetic force to the interaction surfaces 111 and 121 and making it easy to switch the arrangement state of the rotary permanent magnet 130. Although not illustrated, in order to perform more appropriate control, a coil may be further wound around the first pole piece 110 between the gap G and the first permanent magnet 160, and a coil may be further wound between the gap G and the second permanent magnet 170.

Hereinafter, a principle for holding and releasing an object 1, which is a magnetic body, will be described below with reference back to FIGS. 3A to 3E.

Figure 3A:
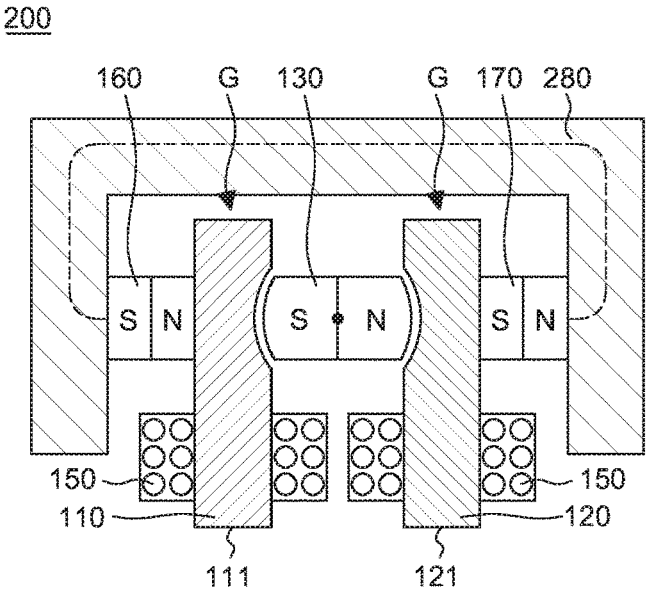
FIGS. 3A to 3E are schematic cross-sectional views illustrating a magnetic force control device according to yet another exemplary embodiment of the present invention. In addition.

First, referring to FIG. 3A, when no current is applied to the coil 150, the rotary permanent magnet 130 is automatically disposed in the first arrangement state as the first and second pole pieces 110 and 120 are magnetized by the first and second permanent magnets 160 and 170. Therefore, the internal circulation magnetic flow is formed through the connecting pole piece 280, as indicated by the dotted line. Therefore, no magnetic flow is formed in the direction toward the interaction surfaces 111 and 121, such that the object cannot be held by the interaction surfaces 111 and 121.

Figure 3B:
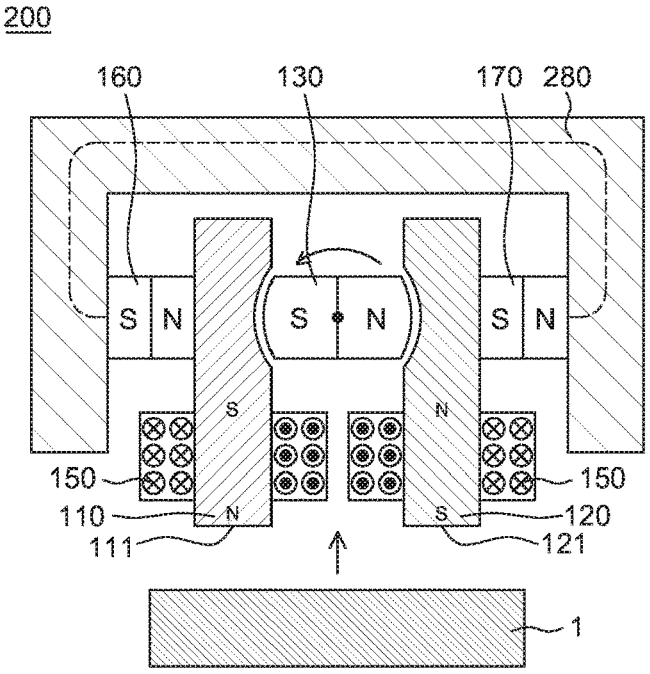

As illustrated in FIG. 3B, the current is applied to the coils 150 to form the magnetic flow in the direction toward the interaction surfaces 111 and 121. That is, the coil 150 wound around the first pole piece 110 is controlled so that the N pole is formed in the direction toward the interaction surface 111 of the first pole piece 110 and the S pole is formed in the opposite direction. The coil 150 wound around the second pole piece 120 is controlled so that the S pole is formed in the direction toward the interaction surface 121 of the second pole piece 120 and the N pole is formed in the opposite direction.

When the current applied to the coil 150 is sufficiently high, a surface of the first pole piece 110 facing the rotary permanent magnet 130 has the S pole, and a surface of the second pole piece 120 facing the rotary permanent magnet 130 has the N pole. Therefore, the rotary permanent magnet 130 receives repulsive force from the respective poles, receives rotational force, and thus rotates, as illustrated in FIG. 3C.

Figure 3C:
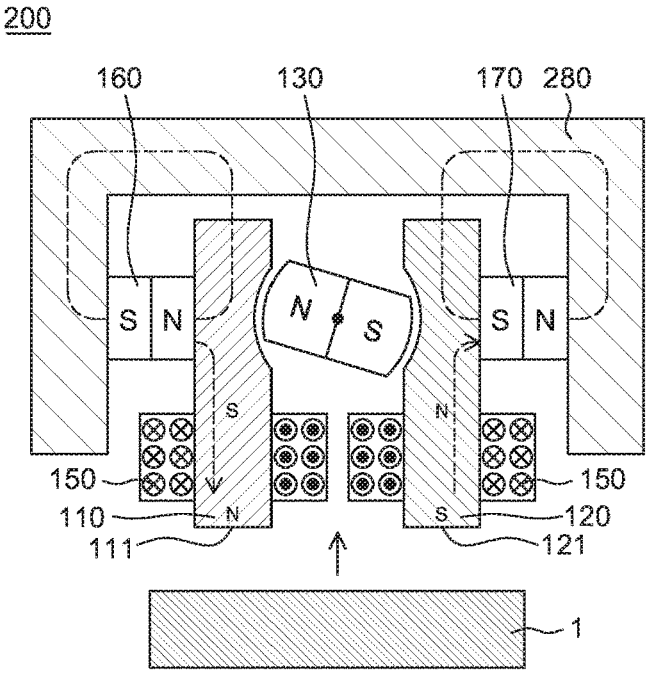

In this case, as illustrated in FIG. 3C, the magnetic flow, which passes through the gap G, is formed, as indicated by the dotted line, while the rotary permanent magnet 130 rotates. Of course, the N pole and the S pole are formed on the interaction surfaces 111 and 121, respectively, by the current applied to the coil 150.

Figure 3D:
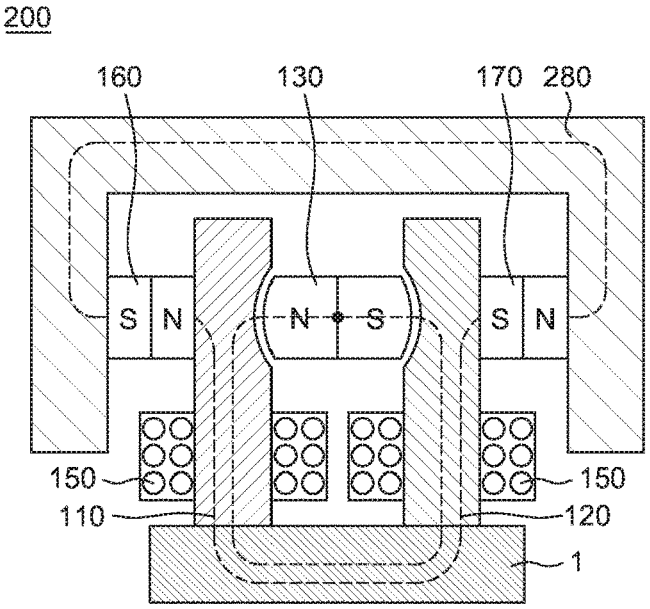

When the object 1 approaches the interaction surfaces 111 and 121, the magnetic flow passing through the gap G is weakened. As illustrated in FIG. 3D, the magnetic flow from the rotary permanent magnet 130, the first permanent magnet 160, and the second permanent magnet 170 passes through the object 1, such that the object 1 is securely held by the interaction surfaces 111 and 121.

In other words, the object 1 is held by the interaction surfaces 111 and 121 after or before the rotary permanent magnet 130 switches the arrangement state. Once the magnetic flow is formed as illustrated in FIG. 3D, the current applied to the coil 150 may be eliminated. However, in order to stably fix the rotary permanent magnet 130, it is advantageous to apply the current to some extent in the direction illustrated in FIG. 3B without completely eliminating the current applied to the coil 150. The amount of current to be applied to the coil 150 to some extent to ensure stability may be determined depending on thicknesses and shapes of the pole pieces 110, 120, and 280, intensity of the permanent magnets 130, 160, and 170, a thickness of the object 1, or the like.

Figure 3E:
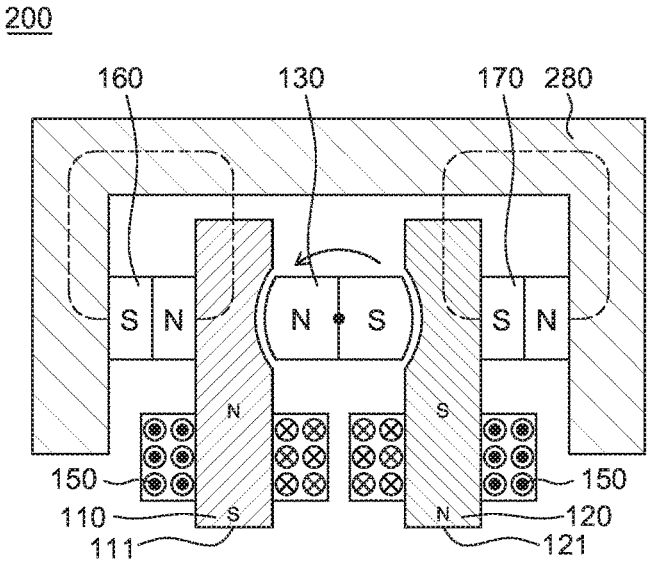
Figure 3F:
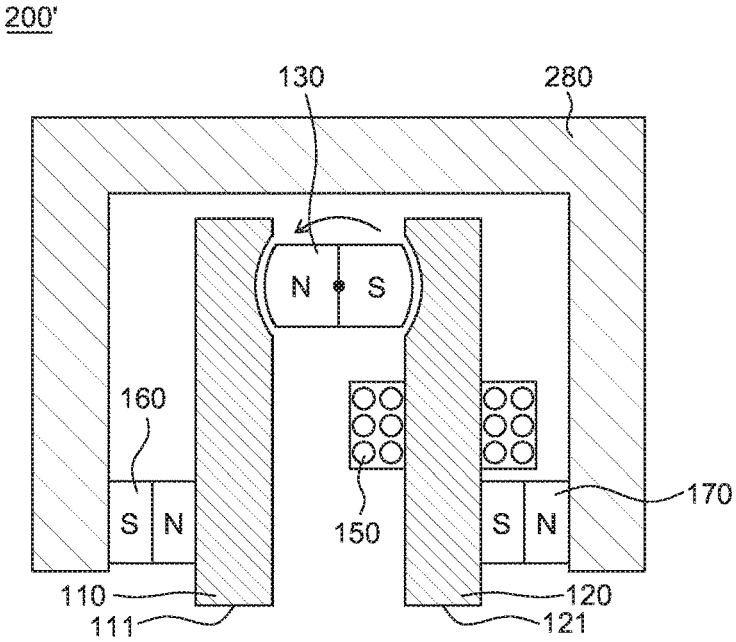
FIG. 3F is a cross-sectional view illustrating a magnetic force control device made by modifying the magnetic force control device illustrated in FIGS. 3A to 3E.

As illustrated in FIG. 3E, the current is applied to the coil 150 to release the held object 1. That is, when the current is applied to the coil 150 in the direction opposite to the direction illustrated in FIG. 3B, the surface of the first pole piece 110 facing the rotary permanent magnet 130 has the N pole, and the surface of the second pole piece 120 facing the rotary permanent magnet 130 has the S pole. In this case, the rotary permanent magnet 130 receives repulsive force from the respective poles and receives rotational force, such that the arrangement state is switched to the first arrangement state, as illustrated in FIG. 3A. Therefore, the object 1 may be released from the interaction surfaces 111 and 121.

Once the rotary permanent magnet 130 switches to the first arrangement state, the internal circulation magnetic flow is formed as indicated by the dotted line in FIG. 3A even though no current is applied to the coil 150, and as a result, the object 1 cannot be held by the interaction surfaces 111 and 121.

Meanwhile, because the rotation direction of the rotary permanent magnet 130 illustrated in FIGS. 3B and 3E is illustrative, and the rotary permanent magnet 130 may rotate in any direction. Even in the following description, the rotation direction of the rotary permanent magnet 130 is just illustrative.

Referring to FIG. 3F, the rotary permanent magnet 130, the first permanent magnet 160, and the second permanent magnet 170 may not be disposed in a straight line unlike FIGS. 3A to 3E. In this case, the coil 150 may be disposed on the second pole piece 120 between the rotary permanent magnet 130 and the second permanent magnet 170. However, the disposition of the coil 150 illustrated in FIG. 3F is illustrative, and the coil 150 may be disposed only on the first pole piece 110 between the rotary permanent magnet 130 and the first permanent magnet 160. In addition, the coils 150 may be disposed on both the first pole piece 110 and the second pole piece 120.

A magnetic force control device 200' in FIG. 3F is advantageous in controlling the magnetic flow, and the minimum number of coils 150 may be used.

FIGS. 4A to 4E are schematic cross-sectional views illustrating a magnetic force control device according to yet another exemplary embodiment of the present invention.

Referring to FIGS. 4A to 4E, a magnetic force control device 300 according to the present exemplary embodiment includes the first pole piece 110, the second pole piece 120, the rotary permanent magnet 130, the coils 150, the first permanent magnet 160, the second permanent magnet 170, a connecting pole piece 380, a third pole piece 385, and a fourth pole piece 390.

In the present exemplary embodiment, the first pole piece 110, the second pole piece 120, the rotary permanent magnet 130, the coil 150, the first permanent magnet 160, and the second permanent magnet 170 are identical to those of the magnetic force control device 200 described above with reference to FIGS. 3A to 3E and denoted by the same reference numerals. The repeated description of the identical components will be omitted, and a difference will be specifically described.

In the magnetic force control device 300 according to the present exemplary embodiment, the first permanent magnet 160 and the second permanent magnet 170 are not in contact with the connecting pole piece 380, but the third pole piece 385 and the fourth pole piece 390 are in contact with the first permanent magnet 160 and the second permanent magnet 170 unlike the above-mentioned magnetic force control device 200.

The third pole piece 385 is made of a ferromagnetic material such as iron, and the S pole of the first permanent magnet 160 is in contact with the third pole piece 385. In addition, the fourth pole piece 390 is made of a ferromagnetic material such as iron, and the N pole of the second permanent magnet 170 is in contact with the fourth pole piece 390.

The third pole piece 385 may have an interaction surface 386, and the fourth pole piece 390 may have an interaction surface 391. The interaction surfaces 386 and 391 is configured to hold the object 1, together with the interaction surfaces 111 and 121 of the first and second pole pieces 110 and 120.

The connecting pole piece 380 is configured to be movable between a first position (positions in FIGS. 4A, 4B, and 4C) at which the connecting pole piece 380 is magnetically connected to the third pole piece 385 and the fourth pole piece 390 and a second position (positions in FIGS. 4D and 4E) at which the connecting pole piece 380 is not magnetically connected to at least one of the third pole piece 385 and the fourth pole piece 390.

Figure 4A:
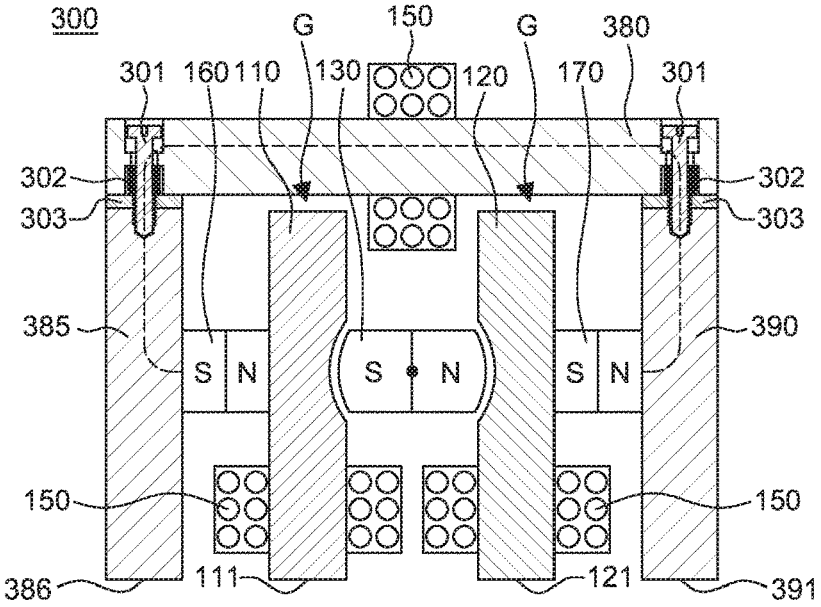
FIGS. 4A to 4E are schematic cross-sectional views illustrating a magnetic force control device according to another exemplary embodiment of the present invention.

Even though the connecting pole piece 380 is positioned at the first position illustrated in FIG. 4A, the connecting pole piece 380 is spaced apart from the first pole piece 110 and the second pole piece 120 while having the gap G so as to be magnetically connected to the first pole piece 110 and the second pole piece 120.

The connecting pole piece 380 is movably fixed to the third pole piece 385 and the fourth pole piece 390 by bolts 301. Counter bores are formed in the connecting pole piece 380, and the heads of the bolts 301 are caught by the counter bore, such that a movement distance restricted.

An elastic member 302 such as a spring may be interposed between the connecting pole piece 380, the third pole piece 385, and the fourth pole piece 390. The elastic member 302 applies force to the connecting pole piece 380 in a direction in which the connecting pole piece 380 becomes distant from the third pole piece 385 and the fourth pole piece 390.

In addition, an impact mitigating member 303 having elasticity may be interposed between the connecting pole piece 380 and the third pole piece 385 or between the connecting pole piece 380 and the fourth pole piece 390 in order to mitigate impact occurring when the connecting pole piece 380 moves from the second position to the first position. The impact mitigating member 303 may be made of rubber, polymer, or the like in the form of a plate, and a non-magnetic material, which does not affect the magnetic flow, may be used for the impact mitigating member 303.

Meanwhile, the coil 150 may be further wound around the connecting pole piece 380 to more appropriately control the magnetic flow.

A principle for holding and releasing the object 1, which is a magnetic body, will be described below with reference back to FIGS. 4A to 4E.

First, referring to FIG. 4A, when no current is applied to the coil 150, the rotary permanent magnet 130 is automatically disposed in the first arrangement state as the first and second pole pieces 110 and 120 are magnetized by the first and second permanent magnets 160 and 170. Further, the connecting pole piece 380 is positioned at the first position, such that the internal circulation magnetic flow is formed through the connecting pole piece 380, as indicated by the dotted line. Therefore, no magnetic flow is formed in the direction toward the interaction surfaces 111, 121, 386, and 391, such that the object cannot be held by the interaction surfaces 111, 121, 386, and 391.

Figure 4B:
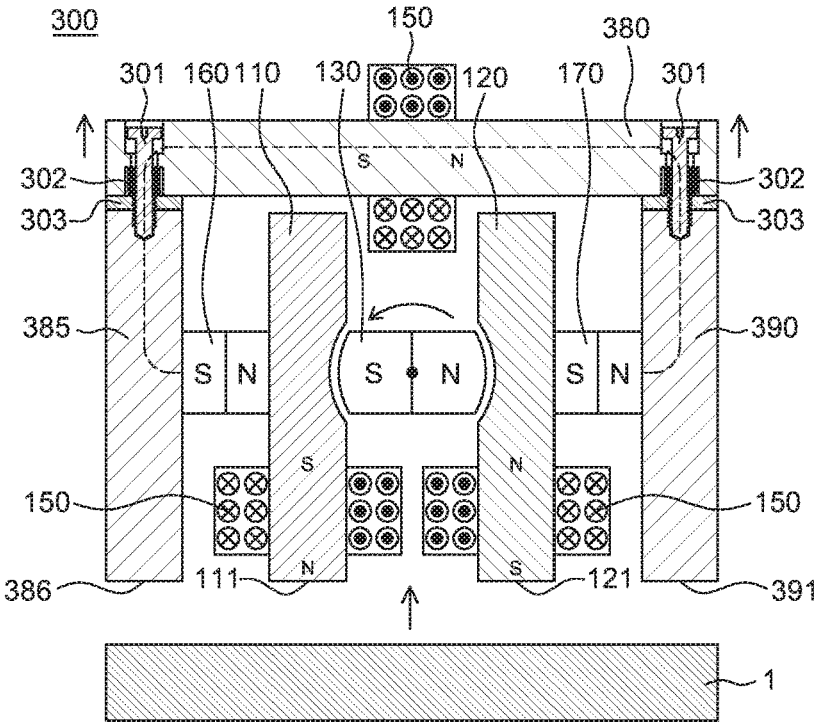

As illustrated in FIG. 4B, the current is applied to the coils 150 to form the magnetic flow in the direction toward the interaction surfaces 111, 121, 386, and 391. That is, the coil 150 wound around the first pole piece 110 is controlled so that the N pole is formed in the direction toward the interaction surface 111 of the first pole piece 110 and the S pole is formed in the opposite direction. The coil 150 wound around the second pole piece 120 is controlled so that the S pole is formed in the direction toward the interaction surface 121 of the second pole piece 120 and the N pole is formed in the opposite direction. The coil 150 is controlled respectively so that the N pole is formed at the right side of the connecting pole piece 380.

When the current applied to the coil 150 is sufficiently high, a surface of the first pole piece 110 facing the rotary permanent magnet 130 has the S pole, and a surface of the second pole piece 120 facing the rotary permanent magnet 130 has the N pole. Therefore, the rotary permanent magnet 130 receives repulsive force from the respective poles, receives rotational force, and thus rotates, as illustrated in FIG. 4C.

Figure 4C:
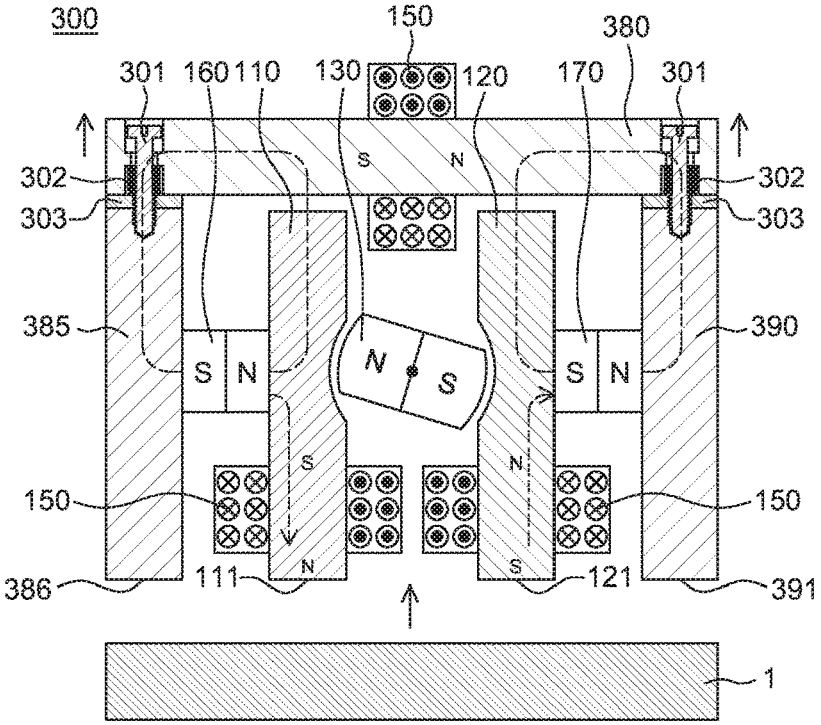

In this case, as illustrated in FIG. 4C, the magnetic flow, which passes through the gap G, is formed, as indicated by the dotted line, while the rotary permanent magnet 130 rotates. Of course, the N pole and the S pole are formed on the interaction surfaces 111 and 121, respectively, by the current applied to the coil 150.

Figure 4D:
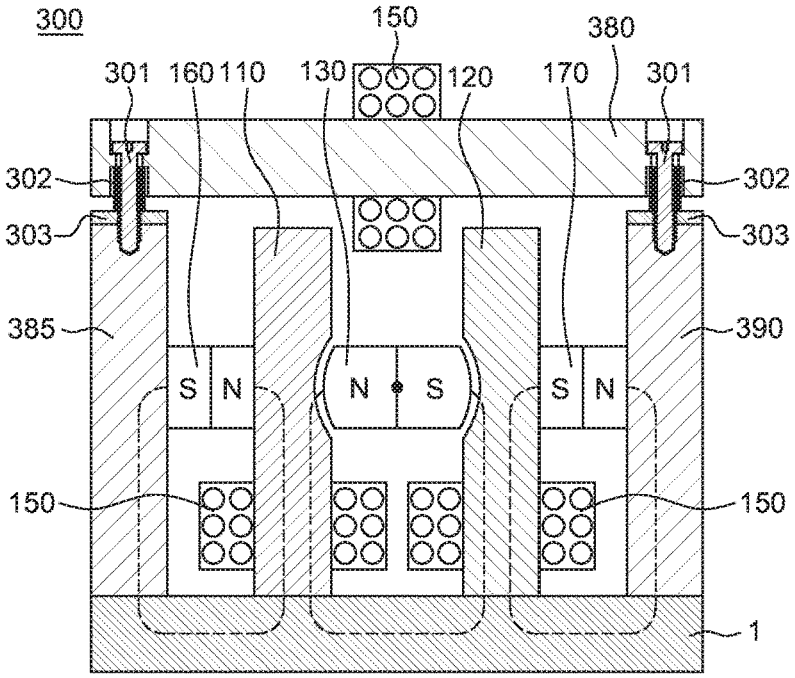

When the object 1 approaches the interaction surfaces 111 and 121, the magnetic flow passing through the gap G is weakened. As illustrated in FIG. 4D, the magnetic flow from the rotary permanent magnet 130, the first permanent magnet 160, and the second permanent magnet 170 passes through the object 1, such that the object 1 is securely held by the interaction surfaces 111 and 121.

In addition, the surface of the connecting pole piece 380 facing the third pole piece 385 has the S pole, and the surface of the connecting pole piece 380 facing the fourth pole piece 390 has the N pole, such that the connecting pole piece 380 is moved to the second position by elastic force of the elastic member 302.

Therefore, as illustrated in FIG. 4D, the rotary permanent magnet 130 is disposed in the second arrangement state, and the connecting pole piece 380 is positioned at the second position. The object 1 is held by the interaction surfaces 111, 121, 386, and 391 before or after the rotary permanent magnet 130 and the connecting pole piece 380 are disposed. With the holding of the object, as illustrated in FIG. 4D, the magnetic flow, which passes through the object 1, is formed, as indicated by the dotted line. Once the magnetic flow is formed as illustrated in FIG. 4D, the current applied to the coil 150 may be eliminated. However, in order to stably fix the rotary permanent magnet 130, it is advantageous to apply the current to some extent in the direction illustrated in FIG. 2B without completely eliminating the current applied to the coil 150. The amount of current to be applied to the coil 150 to some extent to ensure stability may be determined depending on thicknesses and shapes of the pole pieces 110, 120, 380, 385, and 390, intensity of the permanent magnets 130, 160, and 170, a thickness of the object 1, or the like.

Figure 4E:
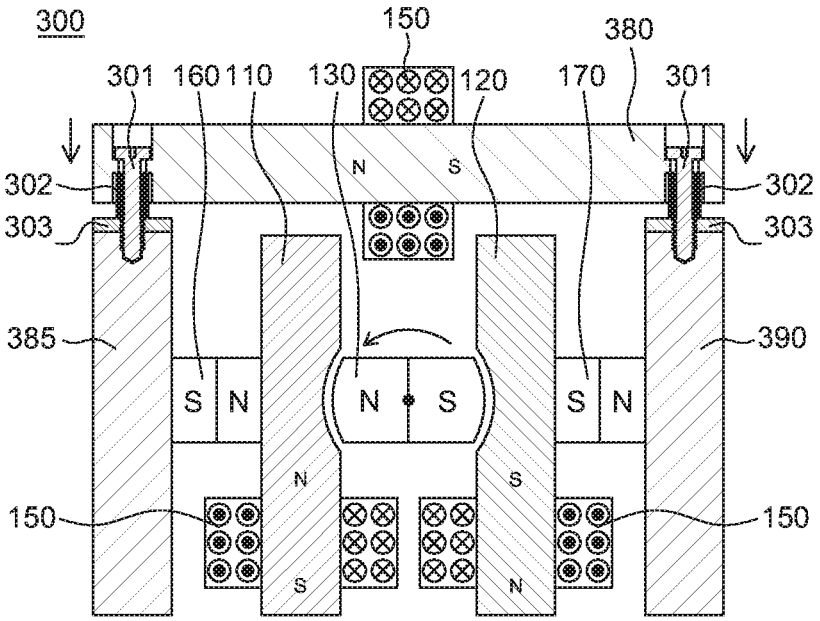

As illustrated in FIG. 4E, the current is applied to the coil 150 to release the held object 1. That is, when the current is applied to the coil 150 in the direction opposite to the direction illustrated in FIG. 4B, the surface of the first pole piece 110 facing the rotary permanent magnet 130 has the N pole, and the surface of the second pole piece 120 facing the rotary permanent magnet 130 has the S pole. In this case, the rotary permanent magnet 130 receives repulsive force from the respective poles and receives rotational force, such that the arrangement state is switched to the first arrangement state, as illustrated in FIG. 4A. In addition, the surface of the connecting pole piece 380 facing the third pole piece 385 has the N pole, and the surface of the connecting pole piece 380 facing the fourth pole piece 390 has the S pole, such that the connecting pole piece 380 is moved to the first position while overcoming the elastic force of the elastic member 302. Therefore, the internal circulation magnetic flow is formed as illustrated in FIG. 4A, and the object 1 may be released from the interaction surfaces 111, 121, 386, and 391.

Once the rotary permanent magnet 130 switches to the first arrangement state and the connecting pole piece 380 moves to the first position, the internal circulation magnetic flow is formed as indicated by the dotted line in FIG. 4A even though no current is applied to the coil 150, and as a result, the object 1 cannot be held by the interaction surfaces 111 and 121.

FIGS. 5A to 5E are schematic cross-sectional views illustrating a magnetic force control device according to yet another exemplary embodiment of the present invention. In addition, FIG. 5F is a schematic cross-sectional view illustrating yet another modified exemplary embodiment of the magnetic force control device illustrated in FIGS. 5A to 5E.

Referring to FIGS. 5A to 5E, a magnetic force control device 400 according to the present exemplary embodiment includes the first pole piece 110, the second pole piece 120, the rotary permanent magnet 130, the coils 150, a permanent magnet 440, and a connecting pole piece 480.

In the present exemplary embodiment, the first pole piece 110, the second pole piece 120, the rotary permanent magnet 130, and the coil 150 are identical to those of the magnetic force control device 100 described above with reference to FIGS. 1A to 1D and denoted by the same reference numerals. The repeated description of the identical components will be omitted, and a difference will be specifically described.

In the present exemplary embodiment, the permanent magnet 440 is disposed such that the N pole is in contact with the first pole piece 110 and the S pole is in contact with the second pole piece 120. The permanent magnet 440 is identical in configuration to the permanent magnet 140 in FIGS. 1A to 1D but different in disposition from the permanent magnet 140. Even though the permanent magnet 440 is denoted by the reference numeral different from the reference numeral of the permanent magnet 140, the permanent magnet 440 is substantially identical to the permanent magnet 140.

The rotary permanent magnet 130 may be positioned to be closer to the interaction surfaces 111 and 121 than the permanent magnet 440. For this reason, the magnetic force on the interaction surfaces 111 and 121 is more easily controlled. However, the permanent magnet 440 may be positioned to be adjacent to the interaction surfaces 111 and 121.

The first pole piece 110 and the second pole piece 120 are spaced apart from the connecting pole piece 480 while having the gap G so as to be magnetically connected to the connecting pole piece 480. Because the configuration of the gap G is as described above, a repeated description thereof will be omitted.

The configuration in which the coils 150 are wound around the first pole piece 110 and the second pole piece 120 between the rotary permanent magnet 130 and the permanent magnet 340, respectively, the coil 150 is wound around the first pole piece 110 between the interaction surface 111 of the first pole piece 110 and the rotary permanent magnet 130, and the coil is wound around the second pole piece 120 between the interaction surface 121 of the second pole piece 120 and the rotary permanent magnet 130 is advantageous in making easy to switch the arrangement state of the rotary permanent magnet 130.

A principle for holding and releasing the object 1, which is a magnetic body, will be described below with reference back to FIGS. 5A to 5E.

Figure 5A:
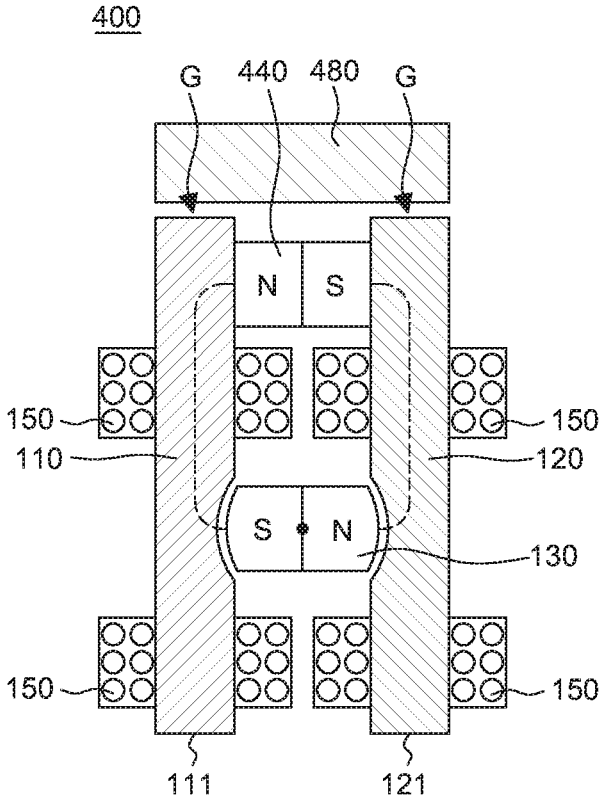
FIGS. 5A to 5E are schematic cross-sectional views illustrating a magnetic force control device according to yet another exemplary embodiment of the present invention. In addition.

First, referring to FIG. 5A, when no current is applied to the coil 150, the rotary permanent magnet 130 is automatically disposed in the first arrangement state as the first and second pole pieces 110 and 120 are magnetized by the permanent magnet 440. Therefore, the internal circulation magnetic flow, which passes through the permanent magnet 440, the first pole piece 110, the rotary permanent magnet 130, and the second pole piece 120, is formed, as indicated by the dotted line. In this case, because of the gap G, the magnetic flow from the permanent magnet 440 is hardly transferred to the connecting pole piece 480. Therefore, no magnetic flow is formed in the direction toward the interaction surfaces 111 and 121, such that the object cannot be held by the interaction surfaces 111 and 121.

Figure 5B:
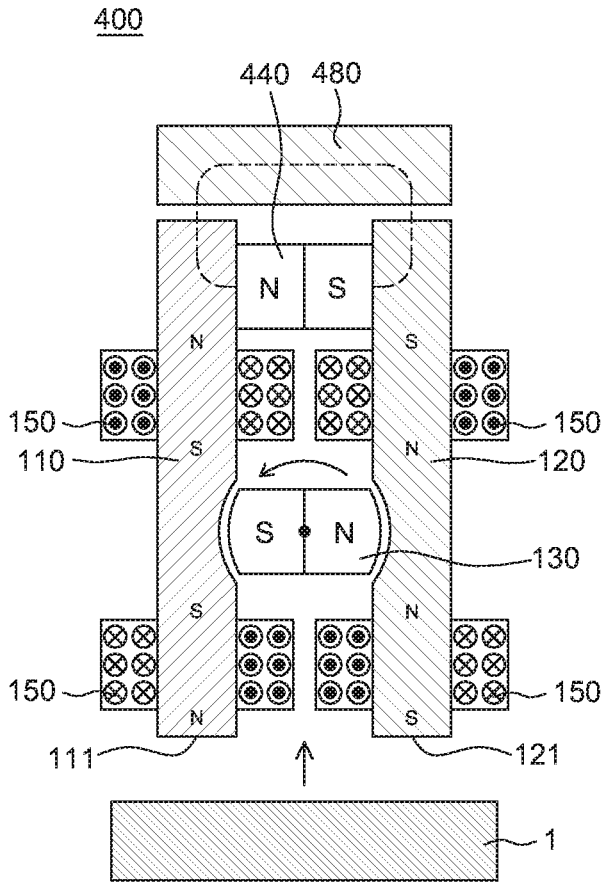

As illustrated in FIG. 5B, the current is applied to the coils 150 to form the magnetic flow in the direction toward the interaction surfaces 111 and 121. That is, the coil 150 is controlled so that the S pole is formed on the first pole piece 110 at a portion adjacent to the S pole of the rotary permanent magnet 130 and the N pole is formed on the second pole piece 120 at a portion adjacent to the N pole of the rotary permanent magnet 130.

When the current applied to the coil 150 is sufficiently high, a surface of the first pole piece 110 facing the rotary permanent magnet 130 has the S pole, and a surface of the second pole piece 120 facing the rotary permanent magnet 130 has the N pole. Therefore, the rotary permanent magnet 130 receives repulsive force from the respective poles, receives rotational force, and thus rotates, as illustrated in FIG. 5C.

Figure 5C:
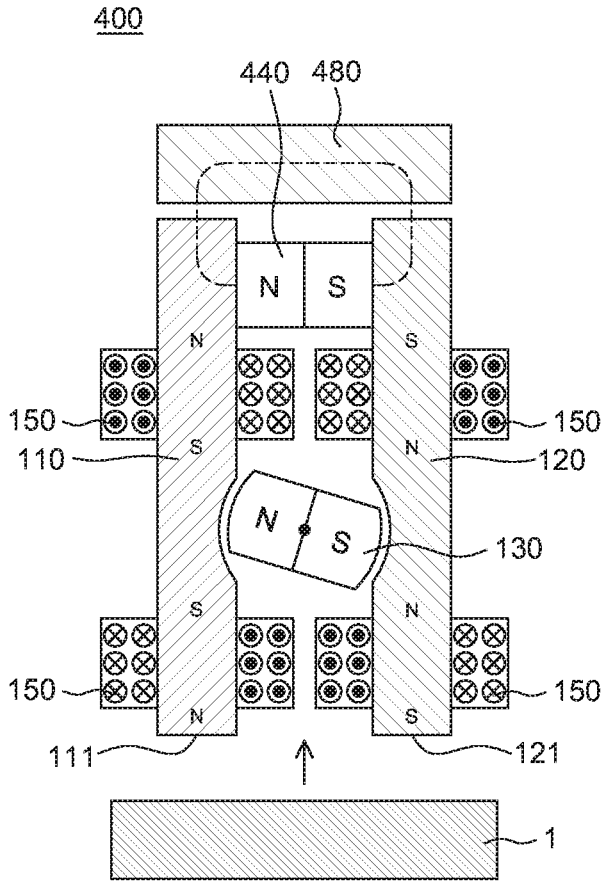

In this case, as illustrated in FIG. 5C, the magnetic flow, which passes through the gap G, is formed, as indicated by the dotted line, while the rotary permanent magnet 130 rotates. Of course, the N pole and the S pole are formed on the interaction surfaces 111 and 121, respectively, by the current applied to the coil 150.

Figure 5D:
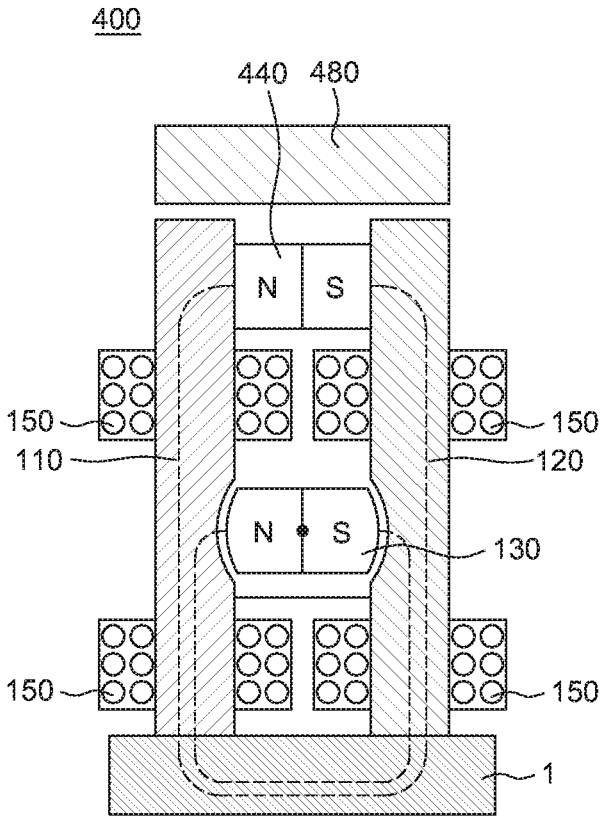

When the object 1 approaches the interaction surfaces 111 and 121, the magnetic flow passing through the gap G is weakened. As illustrated in FIG. 5D, the magnetic flow from the rotary permanent magnet 130 and the permanent magnet 440 passes through the object 1, such that the object 1 is securely held by the interaction surfaces 111 and 121.

The object 1 is held by the interaction surfaces 111 and 121 after or before the rotary permanent magnet 130 switches the arrangement state. With the holding of the object, as illustrated in FIG. 5D, the magnetic flow, which passes through the object 1, is formed, as indicated by the dotted line. Once the magnetic flow is formed as illustrated in FIG. 5D, the current applied to the coil 150 may be eliminated. However, in order to stably fix the rotary permanent magnet 130, it is advantageous to apply the current to some extent in the direction illustrated in FIG. 5B without completely eliminating the current applied to the coil 150 positioned between the rotary permanent magnet 130 and the interaction surfaces 111 and 121. The amount of current to be applied to the coil 150 to some extent to ensure stability may be determined depending on thicknesses and shapes of the pole pieces 110, 120, and 480, intensity of the permanent magnets 130 and 440, a thickness of the object 1, or the like.

Figure 5E:
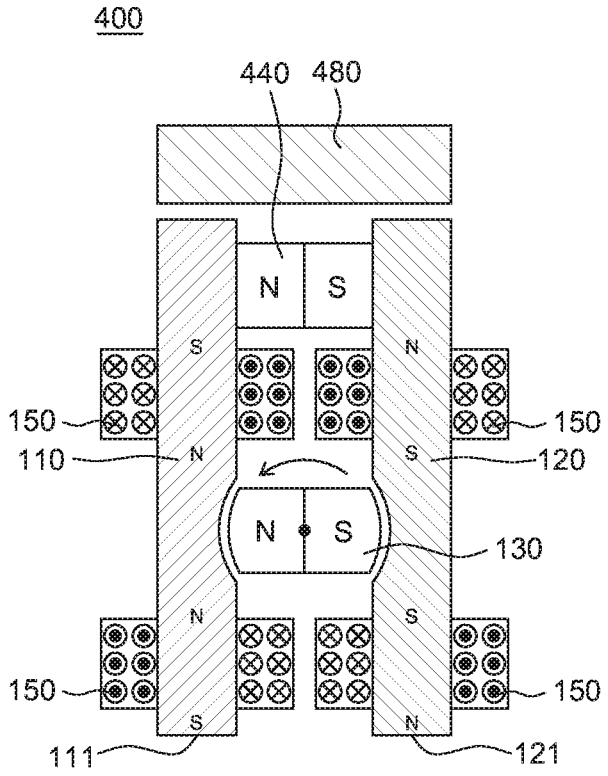
Figure 5F:
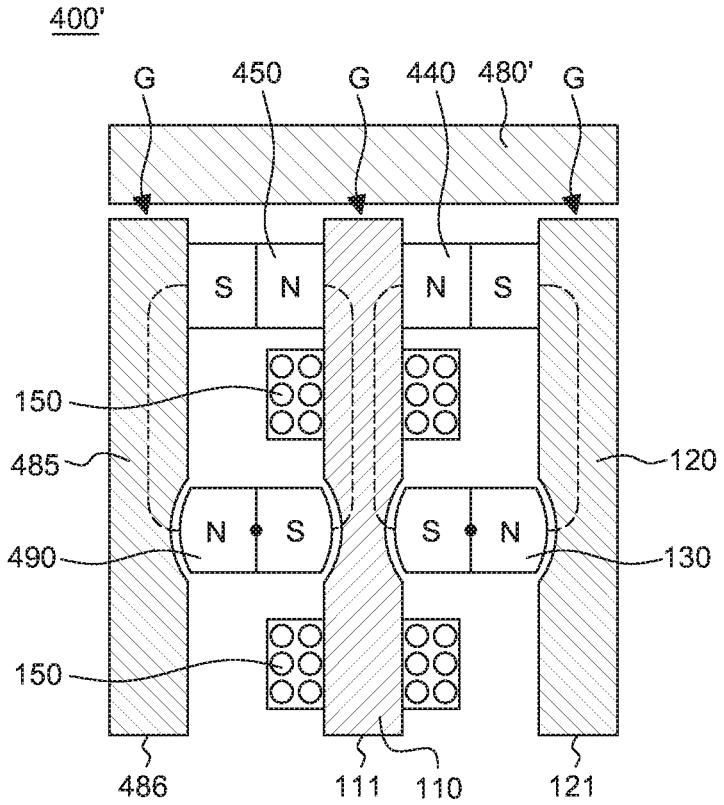
FIG. 5F is a schematic cross-sectional view illustrating yet another modified exemplary embodiment of the magnetic force control device illustrated in FIGS. 5A to 5E.

As illustrated in FIG. 5E, the current is applied to the coil 150 to release the held object 1. That is, when the current is applied to the coil 150 in the direction opposite to the direction illustrated in FIG. 5B, the surface of the first pole piece 110 facing the rotary permanent magnet 130 has the N pole, and the surface of the second pole piece 120 facing the rotary permanent magnet 130 has the S pole. In this case, the rotary permanent magnet 130 receives repulsive force from the respective poles and receives rotational force, such that the arrangement state is switched to the first arrangement state, as illustrated in FIG. 5A. Therefore, the object 1 may be released from the interaction surfaces 111 and 121.

Once the rotary permanent magnet 130 switches to the first arrangement state, the internal circulation magnetic flow is formed as indicated by the dotted line in FIG. 3A even though no current is applied to the coil 150, and as a result, the object 1 cannot be held by the interaction surfaces 111 and 121.

Referring to FIG. 5F, a magnetic force control device 400', which is a modified example, further includes a third pole piece 485, a second permanent magnet 450, and a second rotary permanent magnet 490 in addition to the configuration of the magnetic force control device 400.

The third pole piece 485 has an interaction surface 486 and is made of a ferromagnetic material such as iron.

The second permanent magnet 450 is disposed such that the N pole is in contact with the first pole piece 110 and the S pole is in contact with the third pole piece 485.

The second rotary permanent magnet 490 is configured to be rotatable to define the first arrangement state in which the N pole is magnetically connected to the third pole piece 485 and the S pole is magnetically connected to the first pole piece 110 and the second arrangement state in which the N pole is magnetically connected to the first pole piece 110 and the S pole is magnetically connected to the third pole piece 485.

The connecting pole piece 480' is spaced apart from the first pole piece 110, the second pole piece 120, and the third pole piece 485 while having the gap G so as to be magnetically connected to the first pole piece 110, the second pole piece 120, and the third pole piece 485.

As described above, the magnetic force control device 400 in FIGS. 5A to 5E may be expanded laterally. Because the specific operational principle is identical to the operational principle of the above-mentioned magnetic force control device 400, a detailed description thereof will be omitted.

FIGS. 6A to 6D are schematic cross-sectional views illustrating a magnetic force control device according to yet another exemplary embodiment of the present invention.

Referring to FIGS. 6A to 6D, a magnetic force control device 500 according to the present exemplary embodiment includes the first pole piece 110, the second pole piece 120, the rotary permanent magnet 130, the coils 150, the permanent magnet 440, and a connecting pole piece 580.

In the present exemplary embodiment, the first pole piece 110, the second pole piece 120, the rotary permanent magnet 130, the permanent magnet 440, and the coil 150 are identical to those of the magnetic force control devices 100, 200, 300, and 400 and denoted by the same reference numerals. The repeated description of the identical components will be omitted, and a difference will be specifically described.

The connecting pole piece 580 is configured to be movable between a first position (positions in FIGS. 6A and 6B) at which the connecting pole piece 580 is not magnetically connected to at least one of the first pole piece 110 and the second pole piece 120 and a second position (positions in FIGS. 6C and 6D) at which the connecting pole piece 580 is magnetically connected to the first pole piece 110 and the second pole piece.

The coil 150 may be wound around at least one of the first pole piece 110, the second pole piece 120, and the connecting pole piece 580. However, in the present exemplary embodiment, the coils 150 may be wound around the first pole piece 110 and the second pole piece 120 between the rotary permanent magnet 130 and the permanent magnet 440, respectively.

The connecting pole piece 580 is movably fixed to the first pole piece 110 and the second pole piece 120 by bolts 501. Counter bores are formed in the connecting pole piece 580, and the heads of the bolts 501 are caught by the counter bore, such that a movement distance restricted.

An elastic member 502 such as a spring may be interposed between the connecting pole piece 580, the first pole piece 110, and the second pole piece 120. The elastic member 502 applies force to the connecting pole piece 580 in a direction in which the connecting pole piece 580 becomes distant from the first pole piece 110 and the second pole piece 120.

In addition, an impact mitigating member 503 having elasticity may be interposed between the connecting pole piece 580 and the first pole piece 110 or between the connecting pole piece 580 and the second pole piece 120 in order to mitigate impact occurring when the connecting pole piece 580 moves from the first position to the second position. The impact mitigating member 503 may be made of rubber, polymer, or the like in the form of a plate, and a non-magnetic material, which does not affect the magnetic flow, may be used for the impact mitigating member 303.

A principle for holding and releasing the object 1, which is a magnetic body, will be described below with reference back to FIGS. 6A to 6D.

Figure 6A:
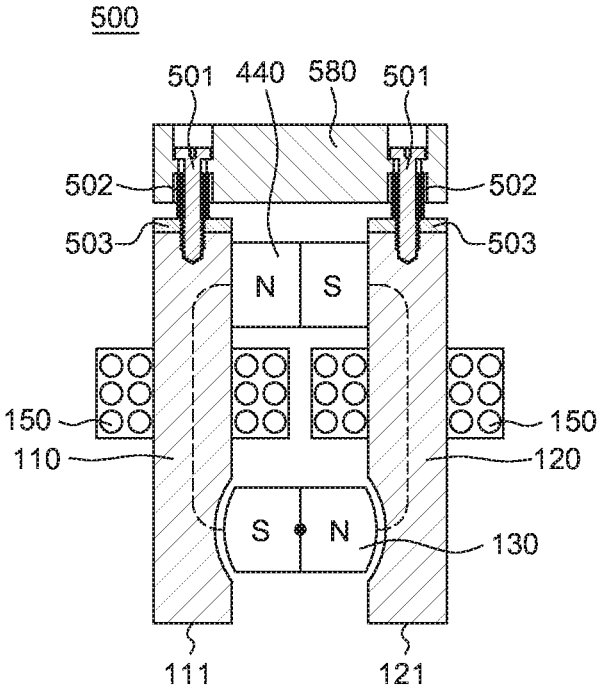
FIGS. 6A to 6D are schematic cross-sectional views illustrating a magnetic force control device according to yet another exemplary embodiment of the present invention.

First, referring to FIG. 6A, when no current is applied to the coil 150, the rotary permanent magnet 130 is automatically disposed in the first arrangement state as the first and second pole pieces 110 and 120 are magnetized by the first and second permanent magnets 140 and 150. Further, the connecting pole piece 580 is positioned at the first position, such that the internal circulation magnetic flow is formed, as indicated by the dotted line. Therefore, no magnetic flow is formed in the direction toward the interaction surfaces 111 and 121, such that the object cannot be held by the interaction surfaces 111 and 121.

Figure 6B:
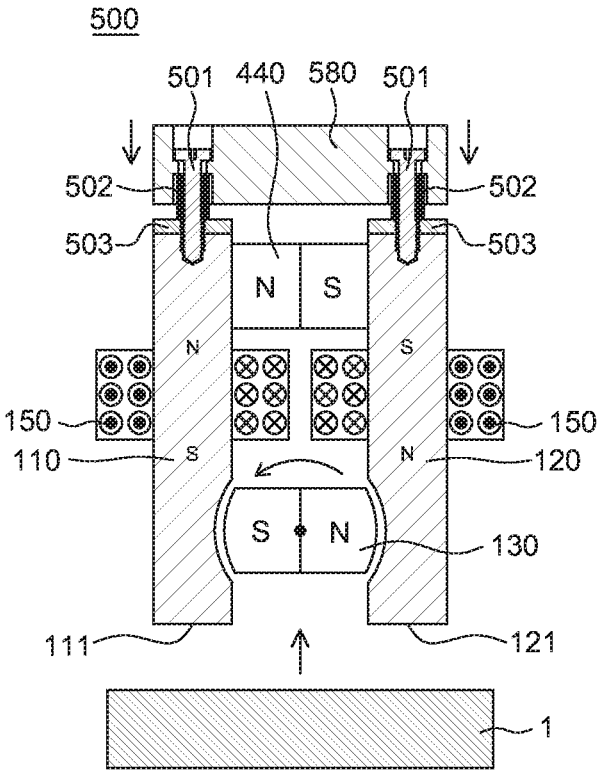

As illustrated in FIG. 6B, the current is applied to the coils 150 to form the magnetic flow in the direction toward the interaction surfaces 111 and 121. That is, the coil 150 wound around the first pole piece 110 is controlled so that the N pole is formed in the direction toward the permanent magnet 440 and the S pole is formed in the direction toward the rotary permanent magnet 130. The coil 150 wound around the second pole piece 120 is controlled so that the S pole is formed in the direction toward the permanent magnet 440 and the N pole is formed in the direction toward the rotary permanent magnet 130.

Figure 6C:
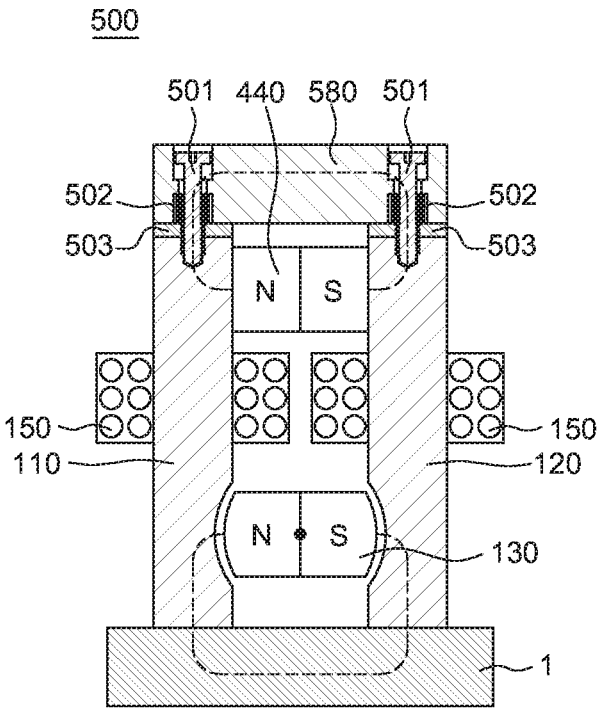

When the current applied to the coil 150 is sufficiently high, a surface of the first pole piece 110 facing the rotary permanent magnet 130 has the S pole, and a surface of the second pole piece 120 facing the rotary permanent magnet 130 has the N pole. Therefore, the rotary permanent magnet 130 receives repulsive force from the respective poles, receives rotational force, and thus rotates, as illustrated in FIG. 6C, such that the arrangement state is switched.

In addition, the first pole piece 110 and the second pole piece 120 attract the connecting pole piece 580, and the connecting pole piece 580 moves to the second position while overcoming elastic force of the elastic member 502. As illustrated in FIG. 4C, when the connecting pole piece 580 is moved, the magnetic flow from the permanent magnet 440 is formed through the connecting pole piece 580.

Therefore, the object 1 is held by the magnetic flow from the rotary permanent magnet 130.

Figure 6D:
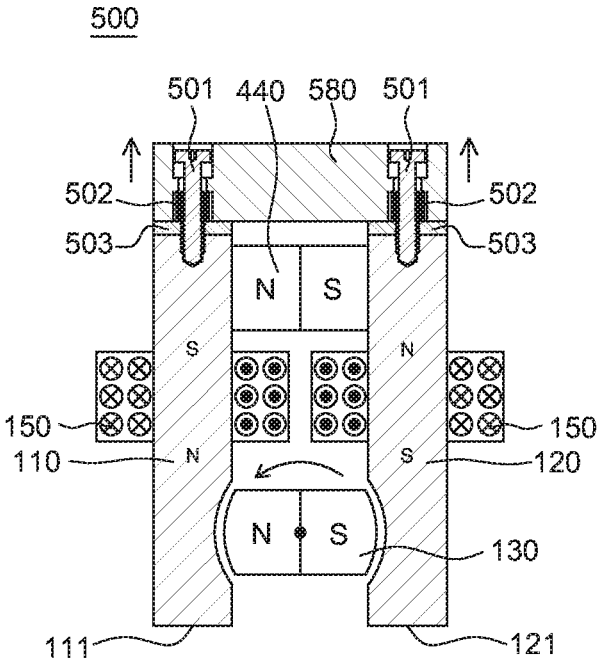
Figure 7A:
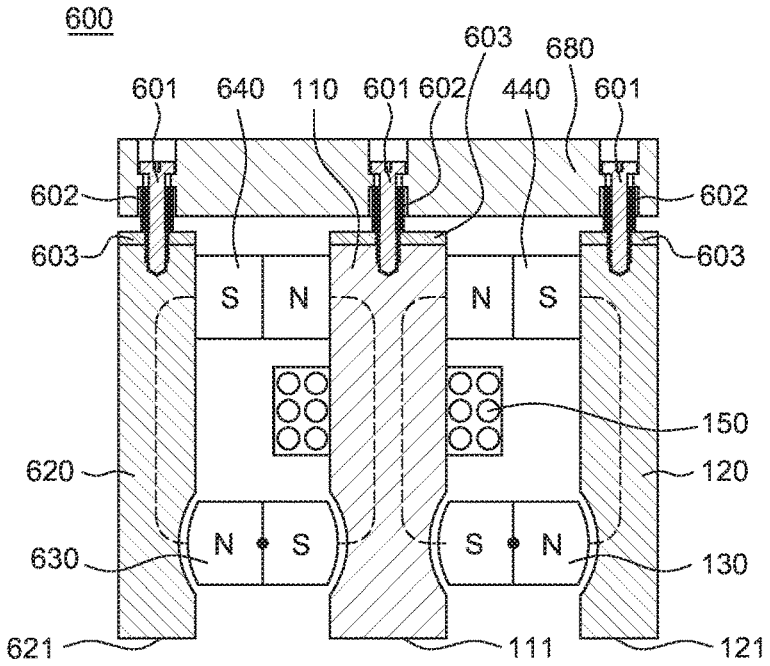
FIGS. 7A to 7D are schematic cross-sectional views illustrating a magnetic force control device according to yet another exemplary embodiment of the present invention.
Figure 7B:
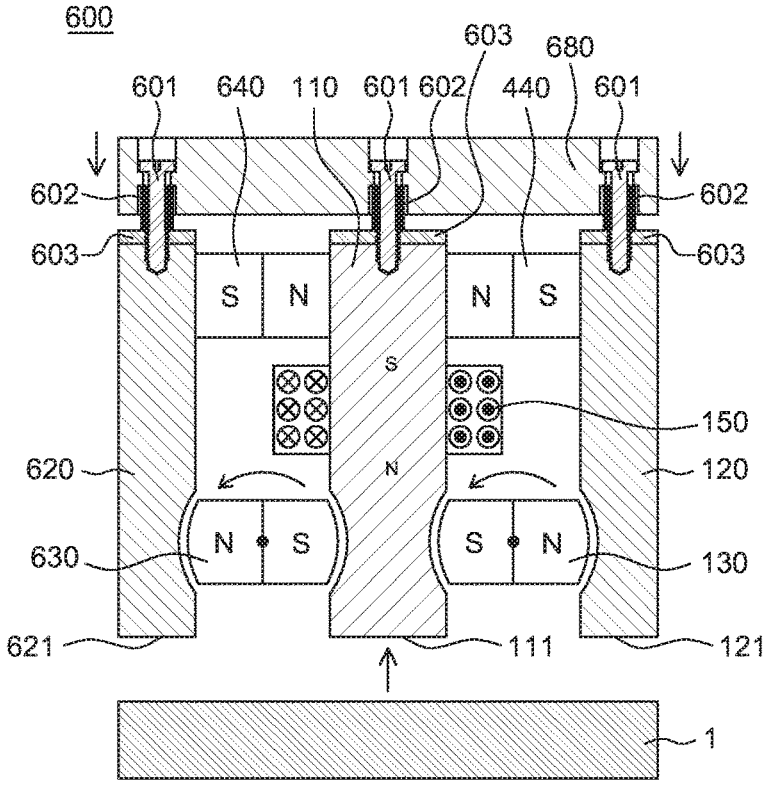
Figure 7C:
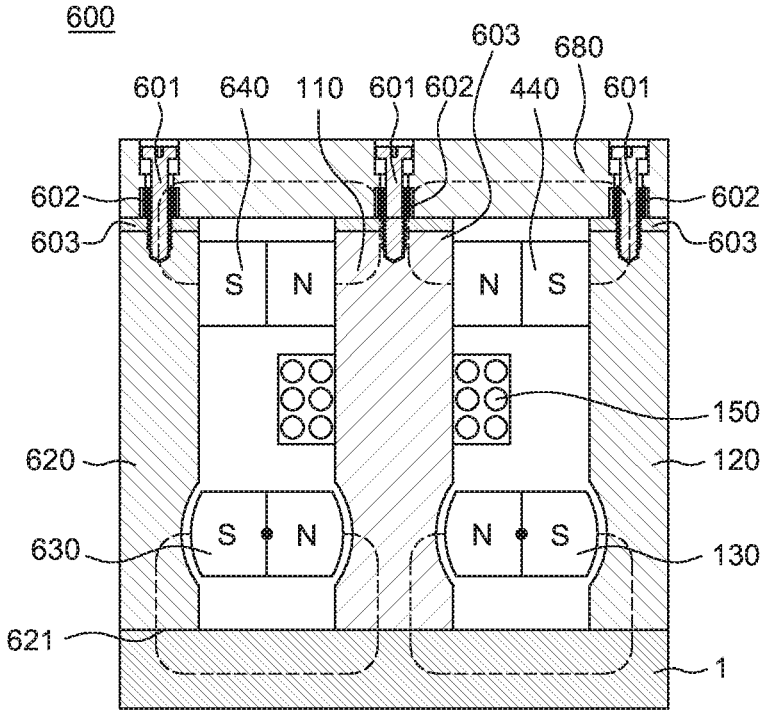
Figure 7D:
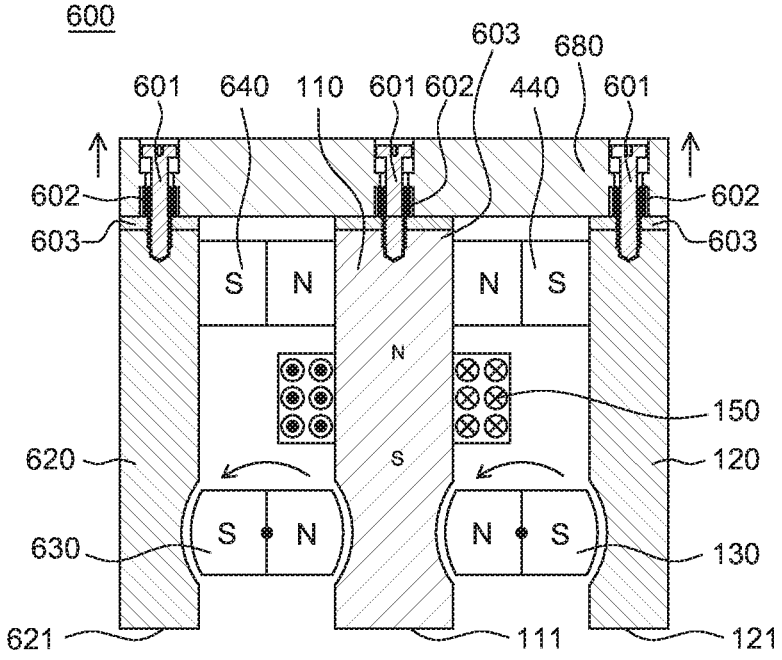

As illustrated in FIG. 6D, the current is applied to the coil 150 to release the held object 1. That is, when the current is applied to the coil 150 in the direction opposite to the direction illustrated in FIG. 6B, the surface of the first pole piece 110 facing the rotary permanent magnet 130 has the N pole, and the surface of the second pole piece 120 facing the rotary permanent magnet 130 has the S pole. In this case, the rotary permanent magnet 130 receives repulsive force from the respective poles and receives rotational force, such that the arrangement state is switched to the first arrangement state, as illustrated in FIG. 6A. In addition, the force of the first and second pole pieces 110 and 120, which attracts the connecting pole piece 580, is weakened, such that the connecting pole piece 580 returns to the first position by means of elasticity of the elastic member 502. Therefore, the internal circulation magnetic flow is formed as illustrated in FIG. 6A, and the object 1 may be released from the interaction surfaces 111 and 121.

FIGS. 7A to 7D are schematic cross-sectional views illustrating a magnetic force control device according to yet another exemplary embodiment of the present invention.

Referring to FIGS. 7A to 7D, a magnetic force control device 600 according to the present exemplary embodiment includes the first pole piece 110, the second pole piece 120, the first rotary permanent magnet 130, the first permanent magnet 440, a connecting pole piece 680, the coils 150, a third pole piece 620, a second rotary permanent magnet 630, and a second permanent magnet 640.

The magnetic force control device 600 according to the present exemplary embodiment further includes the third pole piece 620, the second rotary permanent magnet 630, and the second permanent magnet 640 in addition to the configuration of the magnetic force control device 500, and the magnetic force control device 600 has a structure modified from the connecting pole piece 680. The components for performing the same functions are denoted by the reference numerals identical to the reference numerals indicated in FIGS. 6A to 6D.

The magnetic force control device 600 according to the present exemplary embodiment is made by expanding the magnetic force control device 500 and further includes the third pole piece 620. The third pole piece 620 has an interaction surface 621 and is made of a ferromagnetic material such as iron.

The second rotary permanent magnet 630 is configured to be rotatable to define the first arrangement state (arrangement state in FIGS. 7A and 7B) in which the N pole is magnetically connected to the third pole piece 620 and the S pole is magnetically connected to the first pole piece 110 and the second arrangement state (arrangement state in FIGS. 7C and 7D) in which the N pole is magnetically connected to the first pole piece 110 and the S pole is magnetically connected to the third pole piece 620.

The second permanent magnet 640 is disposed such that the N pole is in contact with the first pole piece 110 and the S pole is in contact with the third pole piece 620. The second permanent magnet 640 and the first permanent magnet 440 may be disposed in a row.

The connecting pole piece 680 is configured to be movable between a first position and a second position. The first position is a position (position in FIGS. 7A and 7B) of the connecting pole piece 680 at which the adjacent pole pieces, among the first pole piece 110, the second pole piece 120, and the third pole piece 620, are not magnetically connected to one another. The second position is a position (position in FIGS. 7C and 7D) of the connecting pole piece 680 at which the connecting pole piece 680 is magnetically connected to all the first pole piece 110, the second pole piece 120, and the third pole piece 620.

Because the operational principle of the magnetic force control device 600 according to the present exemplary embodiment is identical to that of the magnetic force control device 500 in FIGS. 6A to 6D, a detailed description thereof will be omitted.

FIGS. 8A to 8D are schematic cross-sectional views illustrating a magnetic force control device according to yet another exemplary embodiment of the present invention.

Referring to FIGS. 8A to 8D, a magnetic force control device 700 according to the present exemplary embodiment includes a center pole piece 710, a peripheral pole piece 720, a permanent magnet 730, a rotary permanent magnet 740, and a coil 750.

The center pole piece 710 has an interaction surface 711 and is made of a ferromagnetic material such as iron.

The peripheral pole piece 720 is disposed to surround at least a part of the center pole piece 710, has an interaction surface 721, and is made of a ferromagnetic material such as iron.

The permanent magnet 730 is disposed such that any one of the N pole and the S pole is in contact with the center pole piece 710 and the other of the N pole and the S pole is in contact with the peripheral pole piece 720. In the present exemplary embodiment, an example in which the N pole is in contact with the center pole piece 710 is described.

In a case in which at least two permanent magnets 730 are provided, the permanent magnets 730 may be symmetrically disposed based on the center pole piece 710.

The rotary permanent magnet 740 is configured to be rotatable to define a first arrangement state (arrangement state in FIGS. 8A and 8B) in which the S pole is spaced apart from and magnetically connected to the center pole piece 710 and the N pole is spaced apart from and magnetically connected to the peripheral pole piece 720 and a second arrangement state (arrangement state in FIGS. 8C and 8D) in which the S pole is spaced apart from and magnetically connected to the peripheral pole piece 720 and the N pole is spaced apart from and magnetically connected to the center pole piece 710.

The rotary permanent magnet 740 may be disposed such that the N pole or the S pole is directed toward the interaction surface 711 of the center pole piece 710 in the first arrangement state or the second arrangement state. That is, the rotary permanent magnet 740 may be configured to be arranged in a longitudinal direction when the center pole piece 710 is long. With this disposition, the magnetic force to the interaction surface 711 of the center pole piece 710 is easily controlled.

The coil 750 is wound around at least one of the center pole piece 710 and the peripheral pole piece 720. In the present exemplary embodiment, the coil 750 may be disposed only on the center pole piece 710.

A principle for holding and releasing the object 1, which is a magnetic body, will be described below with reference back to FIGS. 8A to 8D.

Figure 8A:
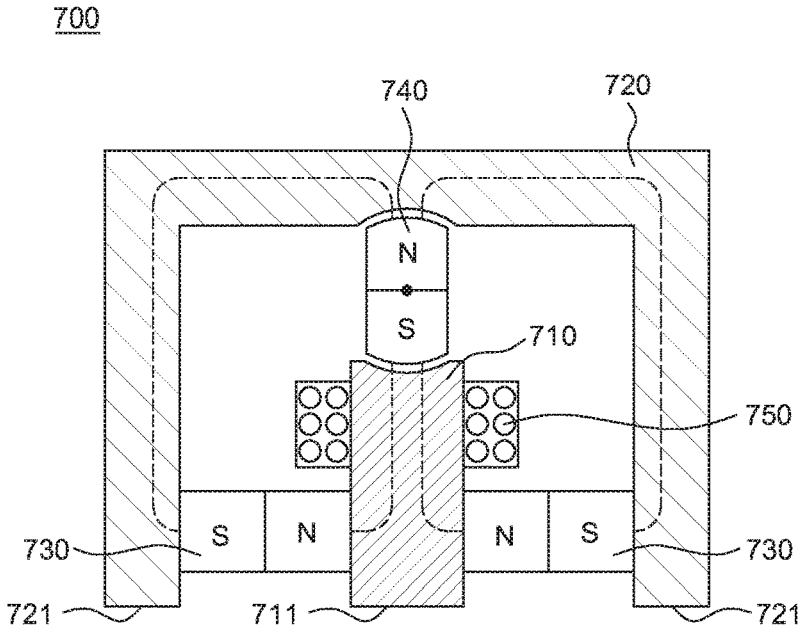
FIGS. 8A to 8D are schematic cross-sectional views illustrating a magnetic force control device according to yet another exemplary embodiment of the present invention.

First, referring to FIG. 8A, when no current is applied to the coil 750, the rotary permanent magnet 740 is in the first arrangement state, and the internal circulation magnetic flow is formed as indicated by the dotted line, such that the object cannot be held by the interaction surfaces 711 and 721.

Figure 8B:
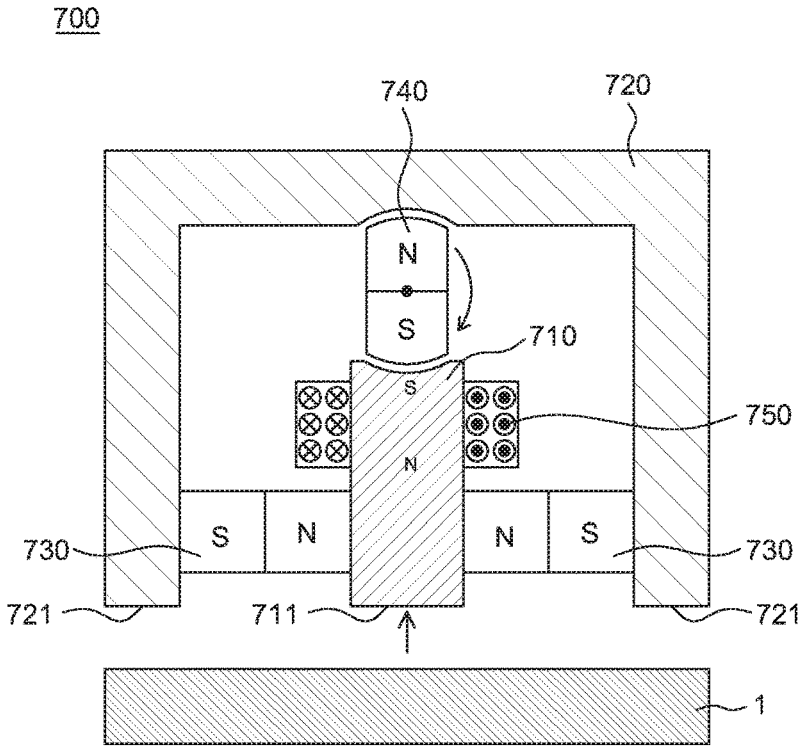

When the current is applied to the coil 750 to hold the object as illustrated in FIG. 8B, the S pole is formed in the direction toward the rotary permanent magnet 730. When the object 1 approaches the interaction surfaces 711 and 721, the rotary permanent magnet 730 is rotated to the second arrangement state as illustrated in FIG. 8C, and the object 1 is held by the interaction surfaces 711 and 721.

Figure 8C:
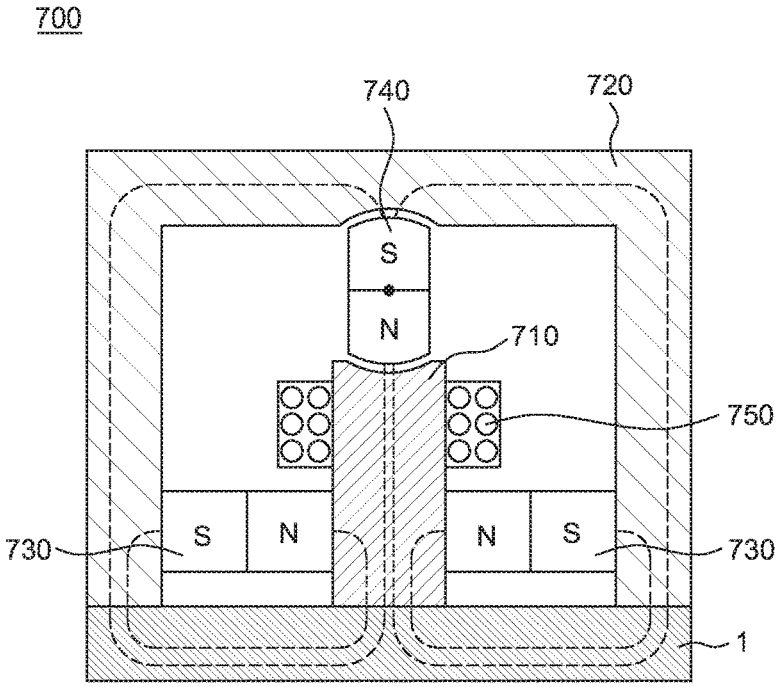

When the object is held, the magnetic flow, which passes through the object 1, is formed as illustrated in FIG. 8C, such that the object is securely held by the interaction surfaces 711 and 721.

Figure 8D:
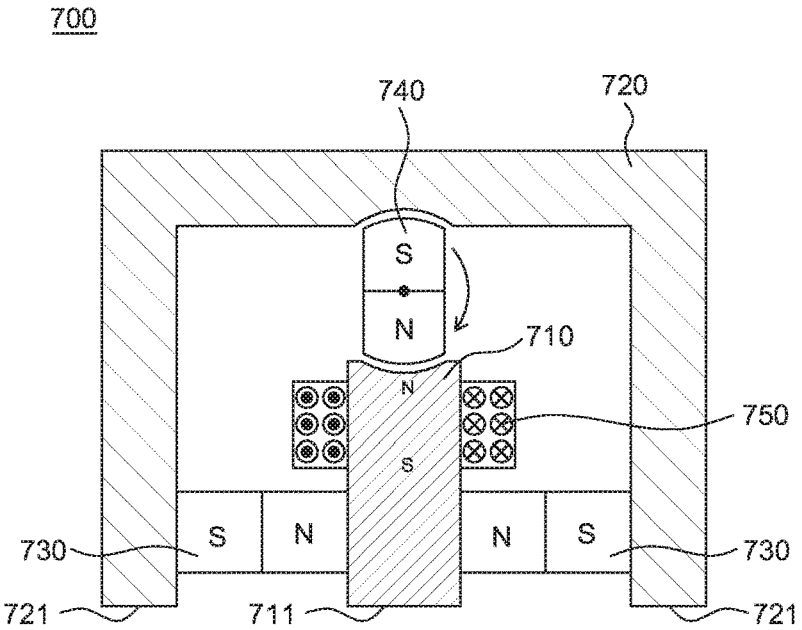

Thereafter, as illustrated in FIG. 8D, when the current is applied to the coil 750 in a direction opposite to the direction illustrated in FIG. 8B to release the object, the N pole is formed in the direction toward the rotary permanent magnet 740, such that the rotary permanent magnet 740 rotates and switches to the first arrangement state as illustrated in FIG. 8A. Therefore, the object 1 is released as the internal circulation magnetic flow is formed as illustrated in FIG. 8A.

Figure 9:
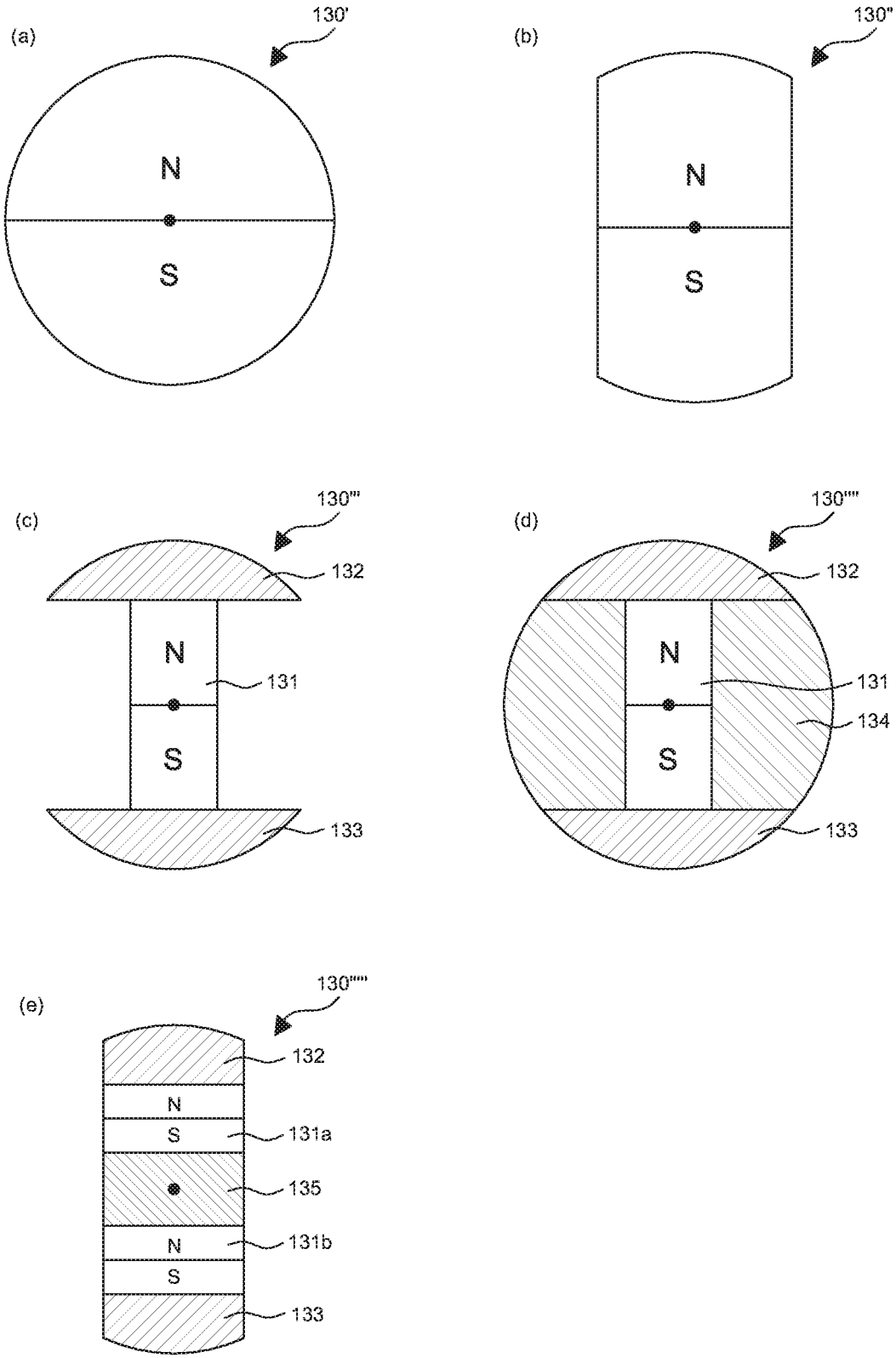
FIG. 9 is cross-sectional views illustrating various exemplary embodiments of a rotary permanent magnet.

FIG. 9 is cross-sectional views illustrating various exemplary embodiments of a rotary permanent magnet.

Referring to FIG. 9A, a rotary permanent magnet 130' may have a cylindrical shape having a circular cross section. In this case, the rotary permanent magnet 130' may be configured as a permanent magnet itself.

Referring to FIG. 9B, a rotary permanent magnet 130" may have an approximately elliptical cross section. In this case, the rotary permanent magnet 130" may be configured as a permanent magnet itself. For reference, this shape is as described above with reference to FIGS. 1 to 6. In addition, the specific description will be described with reference to FIG. 10.

Referring to FIG. 9C, a rotary permanent magnet 130''' may include a permanent magnet 131, an N-pole piece 132, and an S-pole piece 133. The N-pole piece 132 and the S-pole piece 133 may be made of a ferromagnetic material such as iron.

Referring to FIG. 9D, a rotary permanent magnet 130'''' may further include a protective body 134 made of a non-magnetic material in addition to the rotary permanent magnet 130'''. In this case, the rotary permanent magnet 130'''' has a generally cylindrical shape.

Referring to FIG. 9E, a rotary permanent magnet 130''''' may include two permanent magnets 131*a* and 131*b*, an N-pole piece 132, an S-pole piece 133, and an intermediate pole piece 135. The N-pole piece 132, the S-pole piece 133, and the intermediate pole piece 135 may be made of a ferromagnetic material such as iron.

As described above, the configuration of the rotary permanent magnets 130, 130', 130", 130''', 130'''', and 130''''' may be configured as a permanent magnet itself, a combination of a permanent magnet and a pole piece, and a combination of non-magnetic materials. The rotary permanent magnet may be implemented in various ways.

Meanwhile, the above-mentioned rotary permanent magnet 130 may be configured to be mechanically fixed in the first arrangement state or the second arrangement state. That is, after the arrangement state is changed to the first arrangement state and the second arrangement state by the coil, the rotary permanent magnet may be fixed to maintain the arrangement state. The fixing of the rotary permanent magnet may be released only when the arrangement states are changed. With this configuration, an inadvertent rotation of the rotary permanent magnet 130 is prevented, such that the state of holding or releasing an object may be more stably maintained.

Figure 10:
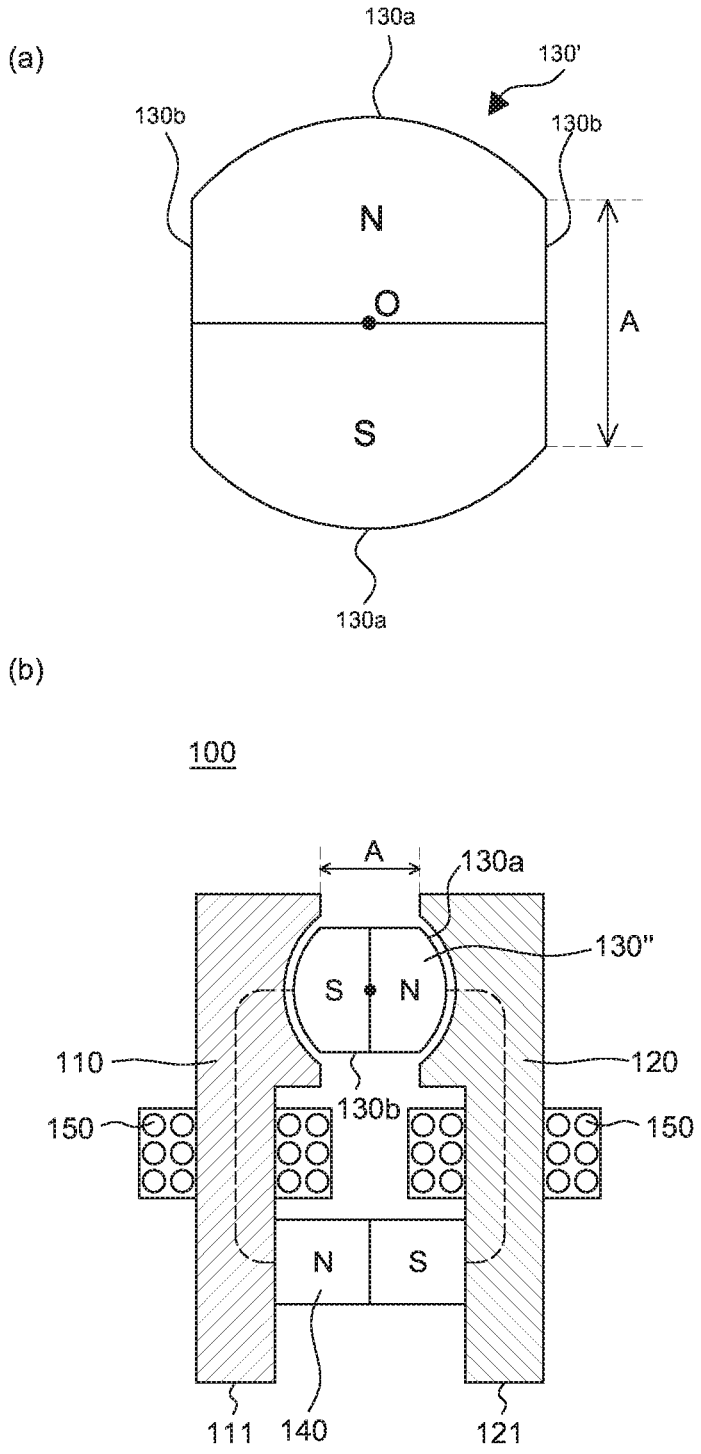
FIG. 10 is a view illustrating one exemplary embodiment of the rotary permanent magnet and a state in which the rotary permanent magnet is disposed in the magnetic force control device.

FIG. 10 is a view illustrating one exemplary embodiment of the rotary permanent magnet and a state in which the rotary permanent magnet is disposed in the magnetic force control device.

Referring to FIG. 10A, the rotary permanent magnet 130" may have circular portions 130*a* having outer edges spaced apart from a rotation center O at an equal distance, and non-circular portions 130*b* having outer edges of which the distance from the rotation center O is smaller than the distance between the rotation center O and the circular portion 130*a*. The N pole and the S pole of the rotary permanent magnet 130" are divided by the non-circular portions 130*b*.

The non-circular portion 130*b* may be formed straight as illustrated in FIG. 10, but this shape is just illustrative, and the non-circular portion 130*b* may have a curved shape.

When the rotary permanent magnet 130" is in the first arrangement state or the second arrangement state, the first pole piece 110 and the second pole piece 120 may face at least a part of the circular portion 130*a* but may not face the non-circular portion 130*b*. More particularly, as illustrated in FIG. 10B, the first pole piece 110 and the second pole piece 120 face the entire circular portion 130*a* when the rotary permanent magnet 130" is in the first arrangement state or the second arrangement state.

The provision of the non-circular portion 130*b* makes it difficult for the rotary permanent magnet 130 to switch between the second arrangement state in FIG. 1C and the first arrangement state in FIG. 1A. In other words, it is possible to more stably maintain the state of holding or releasing the object.

The performance of maintaining the arrangement state is improved as a width A of the non-circular portion 130*b* is increased, but the current applied to the coil 150 to switch the arrangement state is increased. In contrast, as the width A of the non-circular portion 130*b* is decreased, the performance of maintaining the arrangement state deteriorates, but the current applied to the coil 150 to switch the arrangement state is decreased. Therefore, it is possible to appropriately select the A value in consideration of a value of the current required to switch the arrangement state and a value of external impact to be endured.

Meanwhile, a bearing may be used because the rotary permanent magnet 130 is configured to be freely rotatable. However, the bearing is configured as a magnetic body, which makes the rotation difficult, and the bearing is comparatively expensive. Therefore, a bushing structure made of PEEK, PVC, a ceramic material, or the like may be adopted instead of the bearing. In this case, there are advantages in that the rotational structure itself does not have the magnetism, pushing friction between the magnets is reduced, the rotation of the rotary permanent magnet 130 is advantageously performed, and the rotational structure may be implemented at low costs.

Figure 11:
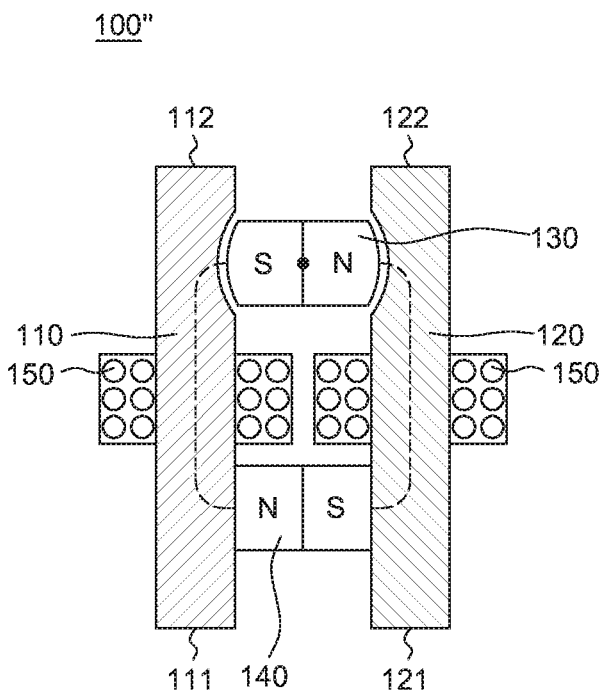
FIG. 11 is a view illustrating a modified example of the magnetic force control device in FIGS. 1A to 1D.
Figure 11:
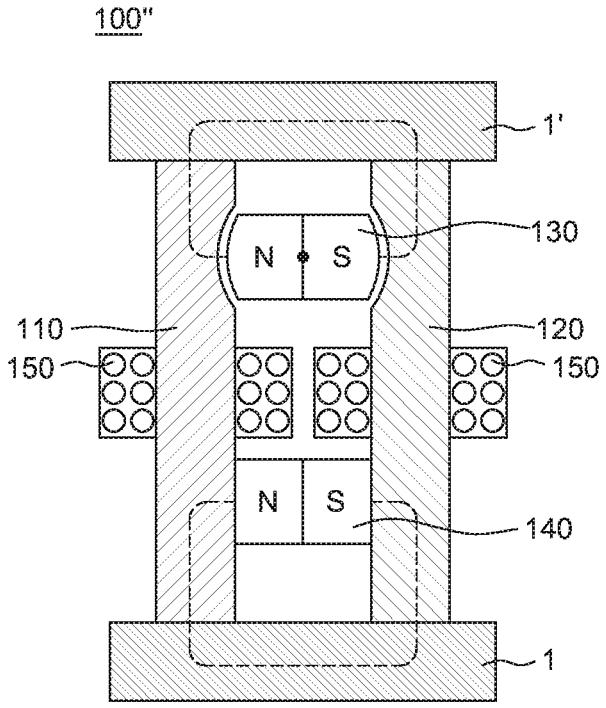

FIG. 11 is a view illustrating a modified example of the magnetic force control device in FIGS. 1A to 1D.

Referring to FIG. 11, a magnetic force control device 100" according to the present exemplary embodiment has the same configuration as the magnetic force control device 100 in FIGS. 1A to 1D except that the magnetic force control device 100" has an additional interaction surface.

The magnetic force control device 100" according to the present exemplary embodiment has additional interaction surfaces 112 and 122 at the rotary permanent magnet 130 in addition to the interaction surfaces 111 and 121 formed at the permanent magnet 140. Specifically, the first pole piece 110 has the two interaction surfaces 111 and 112, and the second pole piece 120 has the two interaction surfaces 121 and 122.

FIG. 11A exemplarily illustrates a controlled state in which no magnetic force is applied to the interaction surfaces 111, 112, 121, and 122, and this state corresponds to the state in FIG. 1A. In addition, FIG. 11B exemplarily illustrates a state in which an object 1 is held by the interaction surfaces 111 and 121 and an object 1' is held by the interaction surfaces 112 and 122, and this state corresponds to the state in FIG. 1C. The difference between the state and the state in FIG. 1C is that the magnetic flow from the rotary permanent magnet 130 is directed toward the object 1' and the object 1' is also held.

The change in arrangement of the rotary permanent magnet 130 between FIGS. 11A and 11B may be performed by applying the current to the coil 150 as illustrated in FIGS. 1B and 1D, and a detailed description will be omitted because the description has been described above.

The operation of magnetic force may be performed on the additional object 1' by means of the additional interaction surfaces 112 and 122, and for example, the object 1' may be held or released. The arrangement, the shapes, the number, and the like of the interaction surfaces may freely vary depending on the shape, the number, and the like of the objects to which the magnetic force is applied.

Figure 12:
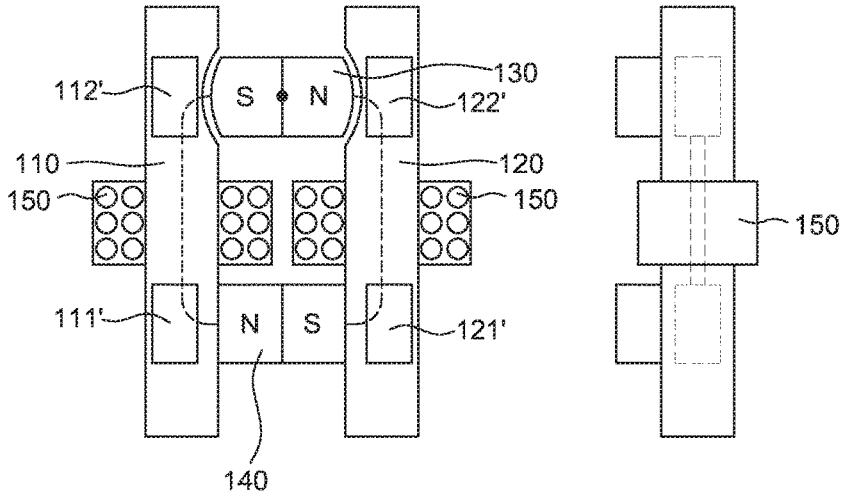
FIG. 12 is a view illustrating a modified example of the magnetic force control device in FIG. 11.
Figure 12:
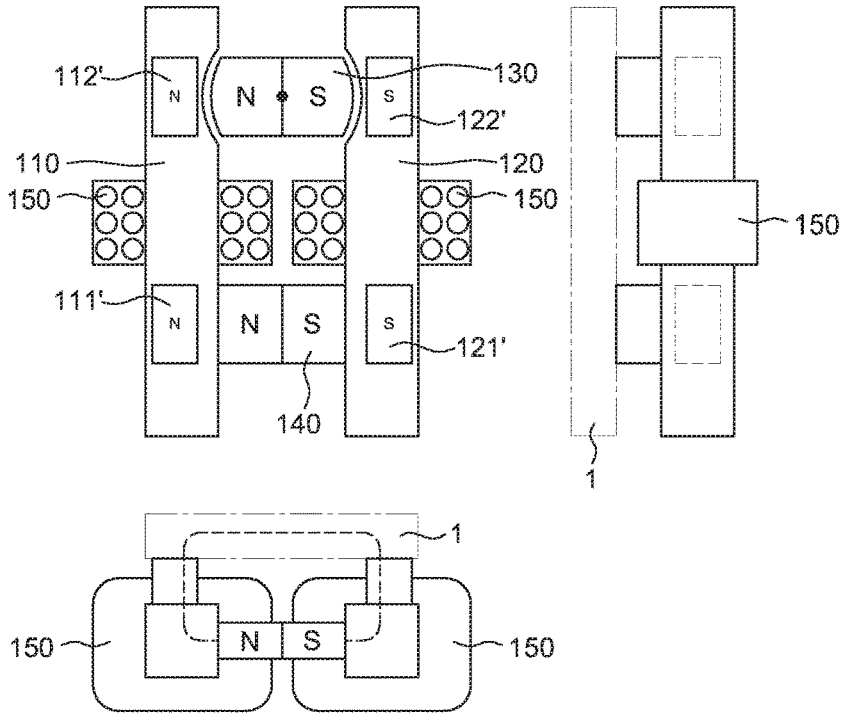

FIG. 12 is a view illustrating a modified example of the magnetic force control device in FIG. 11. Specifically, FIG. 12A is a schematic front view and a side view when the rotary permanent magnet 130 is in the first arrangement state, and FIG. 12B is a schematic front view, a side view, and a bottom view when the rotary permanent magnet 130 is in the second arrangement state. For reference, the coil 150 is illustrated in a cross section only in the front view.

Unlike the magnetic force control device 100" in FIG. 11, in a magnetic force control device 100'" in FIG. 12, the direction of the interaction surfaces 111', 112', 121', and 122' is disposed to be parallel to a direction along a rotation axis of the rotary permanent magnet 130. That is, the magnetic force control device 100'" is configured such that the rotary permanent magnet 130 rotates on a plane parallel to the object 1 held by the interaction surfaces 111', 112', 121', and 122'.

Referring to FIG. 12A, the rotary permanent magnet 130 defines the first arrangement state. In this case, the interaction surfaces 111', 112', 121', and 122' apply almost or absolutely no magnetic effect on the outside magnetic body because of the magnetic flow circulating in the magnetic force control device.

In contrast, as illustrated in FIG. 12B, when the rotary permanent magnet 130 defines the second arrangement state, the interaction surfaces 111' and 112' are magnetized to have the N pole, and the interaction surfaces 121' and 122' are magnetized to have the S pole, such that the magnetic effect may be applied to the magnetic body object 1. Therefore, the magnetic force control device 100'" may hold the object 1.

The change in arrangement of the rotary permanent magnet 130 between FIGS. 12A and 12B may be performed by applying the current to the coil 150 as illustrated in FIGS. 1B and 1D, and a detailed description will be omitted because the description has been described above.

The magnetic force control device 100'" of the present exemplary embodiment is configured such that the rotary permanent magnet 130 rotates on the plane parallel to the object 1, and as a result, a compact configuration having a small height may be implemented.

While the exemplary embodiments of the present invention have been described with reference to the accompanying drawings, those skilled in the art will understand that the present invention may be carried out in any other specific form without changing the technical spirit or an essential feature thereof. Therefore, it should be understood that the above-described exemplary embodiments are illustrative in all aspects and do not limit the present application.

The invention claimed is:

1. A magnetic force control device comprising:

a first pole piece having a first interaction surface, made of a ferromagnetic material, and configured to be in contact with an N pole of a permanent magnet;

a second pole piece having a second interaction surface, made of a ferromagnetic material, and configured to be in contact with an S pole of the permanent magnet;

a rotary permanent magnet configured to be rotatable to define a first arrangement state in which an N pole of the rotary permanent magnet is magnetically connected to the second pole piece and an S pole of the rotary permanent magnet is magnetically connected to the first pole piece and a second arrangement state in which the N pole of the rotary permanent magnet is magnetically connected to the first pole piece and the S pole of the rotary permanent magnet is magnetically connected to the second pole piece; and a coil wound around at least one of the first pole piece and the second pole piece, wherein switching between the first arrangement state and the second arrangement state is performed by rotating the rotary permanent magnet by controlling a current applied to the coil, such that magnetic forces on the first interaction surface of the first pole piece and the second interaction surface of the second pole piece are controlled, and wherein in the second arrangement state, a first magnetic flow is formed through from the N pole of the rotary permanent magnet, the first interaction surface of the first pole piece, an object, and the second interaction surface of the second pole piece to the S pole of the rotary permanent magnet, a second magnetic flow is formed through from the N pole of the permanent magnet, the first interaction surface of the first pole piece, the object, and the second interaction surface of the second pole piece to the S pole of the permanent magnet, wherein the first magnetic flow and the second magnetic flow are formed to hold the object.

2. The magnetic force control device of claim 1, wherein the first pole piece is in contact with the N pole of the permanent magnet, the second pole piece is in contact with the S pole of the permanent magnet, and the permanent magnet is positioned to be closer to the first interaction surface or the second interaction surface than the rotary permanent magnet.

3. The magnetic force control device of claim 2, wherein the coil is disposed between the permanent magnet and the rotary permanent magnet.

4. The magnetic force control device of claim 1, further comprising:

a connecting pole piece disposed to be magnetically connected to the first pole piece and the second pole piece and made of a ferromagnetic material, wherein the coil is wound around at least one of the first pole piece, the second pole piece, and the connecting pole piece.

5. The magnetic force control device of claim 4, wherein the first pole piece is in contact with an N pole of a first permanent magnet and the second pole piece is in contact with an S pole of a second permanent magnet, the connecting pole piece is in contact with an S pole of the first permanent magnet and in contact with an N pole of the second permanent magnet, and the connecting pole piece is spaced apart from and magnetically connected to the first pole piece and the second pole piece while having a gap.

6. The magnetic force control device of claim 5, wherein the first permanent magnet, the second permanent magnet, and the rotary permanent magnet are disposed in a row.

7. The magnetic force control device of claim 5, wherein the coil is disposed on the first pole piece between the rotary permanent magnet and the first permanent magnet or on the second pole piece between the rotary permanent magnet and the second permanent magnet.

8. The magnetic force control device of claim 5, wherein the coil is disposed between the first interaction surface of the first pole piece and the first permanent magnet, and a second coil is disposed between the second interaction surface of the second pole piece and the second permanent magnet.

9. The magnetic force control device of claim 4, further comprising:

a third pole piece configured to be in contact with an S pole of a first permanent magnet and made of a ferromagnetic material; and a fourth pole piece configured to be in contact with an N pole of a second permanent magnet and made of a ferromagnetic material, wherein the connecting pole piece is configured to be movable between a first position at which the connecting pole piece is magnetically connected to the third pole piece and the fourth pole piece and a second position at which the connecting pole piece is not magnetically connected to at least one of the third pole piece and the fourth pole piece, and wherein the connecting pole piece is spaced apart from and magnetically connected to the first pole piece and the second pole piece while having a gap even though the connecting pole piece is positioned at the first position.

10. The magnetic force control device of claim 9, wherein each of the third pole piece and the fourth pole piece has an interaction surface.

11. The magnetic force control device of claim 9, wherein an impact mitigating member having elasticity is interposed between the connecting pole piece and the third pole piece or between the connecting pole piece and the fourth pole piece.

12. The magnetic force control device of claim 11, wherein the rotary permanent magnet is positioned to be closer to the first interaction surface and the second interaction surface than the permanent magnet.

13. The magnetic force control device of claim 9, wherein an elastic member, which applies force in a direction in which the connecting pole piece becomes distant from the third pole piece or the fourth pole piece, is interposed between the connecting pole piece and the third pole piece or between the connecting pole piece and the fourth pole piece.

14. The magnetic force control device of claim 4, wherein the second pole piece is in contact with the S pole of the permanent magnet, and the connecting pole piece is spaced apart from and magnetically connected to the first pole piece and the second pole piece while having a gap.

15. The magnetic force control device of claim 14, wherein the coil is wound around the first pole piece and a second coil is wound around the second pole piece and wherein the coil and the second coil are positioned between the rotary permanent magnet and the permanent magnet, respectively.

16. The magnetic force control device of claim 4, wherein the second pole piece is in contact with the S pole of the permanent magnet, and the connecting pole piece is configured to be movable between a first position at which the connecting pole piece is not magnetically connected to at least one of the first pole piece and the second pole piece and a second position at which the connecting pole piece is magnetically connected to the first pole piece and the second pole piece.

17. The magnetic force control device of claim 1, wherein the first pole piece is in contact with the N pole of the permanent magnet, the second pole piece is in contact with the S pole of the permanent magnet, the coil is disposed between the permanent magnet and the rotary permanent magnet, the first interaction surface is formed on the first pole piece, the second interaction surface is formed on the second pole piece, respectively, and a direction of the first interaction surface and the second interaction surface is parallel to a direction along a rotation axis of the rotary permanent magnet.

18. A magnetic force control device comprising:

a center pole piece having a first interaction surface and made of a ferromagnetic material;

a peripheral pole piece disposed to surround at least a part of the center pole piece, having a second interaction surface, and made of a ferromagnetic material;

a permanent magnet disposed such that any one of an N pole and an S pole is in contact with the center pole piece and the other of the N pole and the S pole is in contact with the peripheral pole piece;

a rotary permanent magnet configured to be rotatable to define a first arrangement state in which an S pole of the rotary permanent magnet is spaced apart from and magnetically connected to the center pole piece and an N pole of the rotary permanent magnet is spaced apart from and magnetically connected to the peripheral pole piece, and a second arrangement state in which the S pole of the rotary permanent magnet is spaced apart from and magnetically connected to the peripheral pole piece and the N pole of the rotary permanent magnet is spaced apart from and magnetically connected to the center pole piece; and a coil wound around at least one of the center pole piece and the peripheral pole piece, wherein switching between the first arrangement state and the second arrangement state is performed by rotating the rotary permanent magnet by controlling a current applied to the coil, such that magnetic forces on the first interaction surface of the center pole piece and the second interaction surface of the peripheral pole piece are controlled, and wherein in the second arrangement state, a first magnetic flow is formed through from the N pole of the rotary permanent magnet, the first interaction surface of the first pole piece, an object, and the second interaction surface of the second pole piece to the S pole of the rotary permanent magnet, a second magnetic flow is formed through from the N pole of the permanent magnet, the first interaction surface of the first pole piece, the object, and the second interaction surface of the second pole piece to the S pole of the permanent magnet, wherein the first magnetic flow and the second magnetic flow are formed to hold the object.

19. The magnetic force control device of claim 18, wherein at least two permanent magnets are symmetrically disposed based on the center pole piece, and the rotary permanent magnet is disposed such that the N pole of the rotary permanent magnet or the S pole of the rotary permanent magnet is directed toward the interaction surface of the center pole piece in the first arrangement state or the second arrangement state.

20. The magnetic force control device of claim 18, wherein the N pole of the permanent magnet is in contact with the center pole piece, and the coil is wound around the center pole piece between the permanent magnet and the rotary permanent magnet.

* * * * *